US011837045B2

(12) United States Patent
Kitagawa

(10) Patent No.: US 11,837,045 B2
(45) Date of Patent: Dec. 5, 2023

(54) INFORMATION PROVISION SYSTEM, INFORMATION PROVISION DEVICE, AND INFORMATION PROVISION METHOD

(71) Applicant: Universal Entertainment Corporation, Tokyo (JP)

(72) Inventor: Shigehiko Kitagawa, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 150 days.

(21) Appl. No.: 16/726,373

(22) Filed: Dec. 24, 2019

(65) Prior Publication Data

US 2020/0211321 A1 Jul. 2, 2020

(30) Foreign Application Priority Data

Dec. 27, 2018 (JP) ..... 2018-244325

(51) Int. Cl.
*G07F 17/00* (2006.01)
*G07F 17/32* (2006.01)
*G07F 17/34* (2006.01)

(52) U.S. Cl.
CPC ..... *G07F 17/3239* (2013.01); *G07F 17/3209* (2013.01); *G07F 17/3267* (2013.01); *G07F 17/3269* (2013.01); *G07F 17/3213* (2013.01); *G07F 17/34* (2013.01)

(58) Field of Classification Search
CPC ..... G07F 17/3239; G07F 17/3209; G07F 17/3267; G07F 17/3269; G07F 17/3213; G07F 17/34
See application file for complete search history.

(56) References Cited

U.S. PATENT DOCUMENTS

2012/0190423 A1* 7/2012 Yoseloff ..... G07F 17/3293 463/20
2014/0295944 A1* 10/2014 Faircloth ..... G07F 17/3255 463/25
2014/0357361 A1* 12/2014 Rajaraman ..... G07F 17/323 463/31
2015/0031444 A1* 1/2015 Colvin ..... G07F 17/3232 463/25
2020/0005594 A1* 1/2020 Santisi ..... G07F 17/3244

* cited by examiner

*Primary Examiner* — James S. McClellan
*Assistant Examiner* — Jeffrey K Wong
(74) *Attorney, Agent, or Firm* — LEX IP MEISTER, PLLC

(57) ABSTRACT

Player's obsession to a game is avoided. Whether to take an action for a player is determined based on game information of the player who plays a game at a gaming machine, and when an action is taken for the player, benefit information is output to the gaming machine to allow the player to acquire a specific advantage at a location different from the gaming machine.

17 Claims, 21 Drawing Sheets

FIG.14A

| SLOT MACHINE IDENTIFICATION INFORMATION(0010) | | | | |
|---|---|---|---|---|
| INFORMATION CARD IDENTIFICATION INFORMATION(0001) :SUCCESSIVE USE「0」 | | | | |
| DATE AND TIME | INSERTED AMOUNT | GAME RESULT | REMAINING AMOUNT | PAYOUT AMOUNT |
| 20180801 10:00 | 50(CASH) | — | 50 | — |
| 20180801 10:05 | — | △△△ | 80 | — |
| 20180801 10:10 | — | × × × | 20 | — |
| 20180801 10:15 | 30(CASH) | — | 50 | — |
| ⋮ | ⋮ | ⋮ | ⋮ | ⋮ |
| 20180801 11:00 | — | ○○○ | 60 | — |
| 20180801 11:05 | — | — | 0 | 60 |

FIG.14B

| SLOT MACHINE IDENTIFICATION INFORMATION(0011) | | | | |
|---|---|---|---|---|
| INFORMATION CARD IDENTIFICATION INFORMATION(0001) :SUCCESSIVE USE「1」 | | | | |
| DATE AND TIME | INSERTED AMOUNT | GAME RESULT | REMAINING AMOUNT | PAYOUT AMOUNT |
| 20180801 11:30 | 60(CARD) | — | 60 | — |
| ⋮ | ⋮ | ⋮ | ⋮ | ⋮ |
| 20180801 12:00 | — | — | 0 | 10 |

FIG.15

| INFORMATION CARD IDENTIFICATION INFORMATION(0001) | | | | | |
|---|---|---|---|---|---|
| DATE AND TIME | INSERTED AMOUNT | GAME RESULT | REMAINING AMOUNT | PAYOUT AMOUNT | SLOT MACHINE IDENTIFICATION INFORMATION |
| 20180801 10:00 | 50(CASH) | — | 50 | — | 0010 |
| 20180801 10:05 | — | △△△ | 80 | — | 0010 |
| 20180801 10:10 | — | ××× | 20 | — | 0010 |
| ⋮ | ⋮ | ⋮ | ⋮ | ⋮ | ⋮ |
| 20180801 11:00 | — | ○○○ | 60 | — | 0010 |
| 20180801 11:05 | — | — | 0 | 60 | 0010 |
| 20180801 11:30 | 60(CARD) | — | 60 | — | 0011 |
| ⋮ | ⋮ | ⋮ | ⋮ | ⋮ | ⋮ |
| 20180801 12:00 | — | — | 0 | 10 | 0011 |

INFORMATION PROVISION SYSTEM, INFORMATION PROVISION DEVICE, AND INFORMATION PROVISION METHOD

CROSS-REFERENCES TO RELATED APPLICATIONS

The present application claims priority from Japanese Patent Application No. 2018-244325, which was filed on Dec. 27, 2018, the disclosure of which is herein incorporated by reference in its entirety.

BACKGROUND OF THE INVENTION

1. Field of the Invention

The present invention relates to an information provision system, an information provision device, and an information provision method.

2. Description of Related Art

A known slot machine is arranged such that symbols are scroll-displayed and then stopped, and a gaming medium (e.g., coin) is awarded based on the combination of the stop-displayed symbols. Another known slot machine is arranged such that, because a game progresses while a state advantageous for a player is appealed to the player, the player is impressed with an attractive payout rate.

When a player is attracted to such a slot machine and obsessed with the game, the player may spend an amount exceeding a planned amount on the game or may play the game for a longer time than originally planned. Such obsession brings profits to gaming facilities in a short term, but in a long term the players may burn out soon and refrain from playing the game. This could be disadvantageous for both the gaming facilities and the players. To solve this problem, a behavior tracking system which tracks down the behavior of a specific player has been proposed (U.S. Patent Publication No. 2010/0298044).

In this behavior tracking system, because it is necessary to specify a player who is the target of behavior tracking in advance, the player who is tracked down must actively perform membership registration or his/her family must perform membership registration, by presenting individual authentication information. However, many players who are heavily addicted may play games without membership registration. Furthermore, even if a player who is a suspected gambling addict or quasi-addict is found, the player may resist forcible removal from the game by a staff member or by the game system, and a serious trouble may occur. It is noted that such addition or quasi-addiction may also occur in normal games with which no gambling is involved.

SUMMARY OF THE INVENTION

The present invention has been done in consideration of the above, and an object of the present invention is to provide a countermeasure for player's addiction or quasi-addiction to games, etc., while quelling players' antipathy and avoiding troubles.

The present invention relates to an information provision system including:

a gaming machine capable of running a game; and an information provision device capable of communicating with the gaming machine, the information provision device including:

a determination unit which is configured to determine whether to take an action for a player based on game information of the player; and an instruction information transmitter which is configured to transmit instruction information to the gaming machine when the determination unit determines that the action is taken for the player, and the gaming machine including a benefit information output unit which is configured to output, based on the instruction information, benefit information which allows the player to acquire a specific advantage at a location different from the gaming machine to the player.

With this arrangement, when the player leaves the gaming machine in response to the benefit information, the player stops the game play at the gaming machine. For this reason, a countermeasure for player's addiction or quasi-addiction to the game can be done while quelling players' antipathy and avoiding troubles.

The information provision system of the present invention further includes an information manager which is configured to manage game history of the player as the game information, the determination unit of the information provision device determining whether to take the action for the player based on the game history.

With this arrangement, because whether a player is addicted or quasi-addicted to the game is determined based on the game history of the player, a countermeasure for player's addiction or quasi-addiction to the game can be taken without requiring the player to actively take a countermeasure.

In the information provision system of the present invention, the information provision device includes a gaming value receiver which is configured to receive, as the game information, a gaming value used by the player from the gaming machine, and the determination unit determines whether to take the action for the player based on whether an accumulated amount of the gaming value has reached a use amount.

With this arrangement, when the player leaves the gaming machine in response to the benefit information, the player stops the game play at the gaming machine. For this reason, a countermeasure for player's addiction or quasi-addiction to the game can be done while quelling players' antipathy and avoiding troubles.

The information provision system of the present invention further includes an information manager which is configured to manage game history of the player as the game information, and the information provision device includes a use amount setting unit which is configured to set the use amount based on the game history sent from the information manager.

With this arrangement, a countermeasure for player's addiction or quasi-addiction to the game can be taken as a use amount is set for each player based on the game history of each player.

The information provision system of the present invention includes an input device which receives the use amount input by the player.

With this arrangement, because a use amount is input by the player, at which time the player is prompted to leave the gaming machine for another location can be determined by the user.

The information provision system of the present invention includes a benefit issuance device which is provided at a location different from the gaming machine where the player plays the game, and the benefit issuance device includes:

an input unit to which the benefit information is input by the player; and a benefit issuance unit which is configured to issue a benefit associated with the benefit information.

With this arrangement, when the player leaves the gaming machine for the location where the benefit issuance device is provided in order to input the benefit information and receive a benefit from the benefit issuance device, the player has to stop playing the game at the gaming machine. Player's obsession to the game is therefore avoided.

The present invention relates to an information provision system is arranged such that the benefit issuance unit includes:

a benefit display unit which is configured to display plural types of benefits associated with the benefit information;

a selection unit which allows the player to select one of the plural types of benefits displayed by the benefit display unit; and an issuance processing unit which is configured to issue the benefit which is selected by using the selection unit.

With this arrangement, because the player is more likely to acquire a desired benefit as the plural types of benefits are selectable, the player is more likely to acquire the specific advantage at a location different from the gaming machine.

The present invention relates to an information provision system is arranged such that the benefit issuance device includes:

a time measurement unit which is configured to measure time elapsed from output of the benefit information from the gaming machine to input to the input unit by the player; and a benefit issuance control unit which is configured to cause the benefit issuance unit to issue the benefit when an expiration time has not arrived.

With this arrangement, because the expiration time is set for the issuance of benefit, the player is motivated to leave the gaming machine early.

The present invention relates to an information provision device which includes:

a determination unit which is configured to determine whether to take an action for a player based on game information of the player; and an instruction information transmitter which is configured to transmit instruction information to a gaming machine in order to cause the gaming machine to output benefit information which allows the player to acquire a specific advantage at a location different from the gaming machine to the player, when the determination unit determines that the action is taken for the player.

With this arrangement, when the player leaves the gaming machine in response to the benefit information, the player stops the game play at the gaming machine. For this reason, a countermeasure for player's addiction or quasi-addiction to the game can be done while quelling players' antipathy and avoiding troubles.

The present invention relates to an information provision method of causing a player at a gaming machine to stop playing a game, the method comprising the steps of:

determining whether to take an action for the player based on game information of the player playing the game at the gaming machine; and when it is determined that the action is taken for the player, causing the gaming machine to output benefit information which allows the player to acquire a specific advantage at a location different from the gaming machine to the player.

With this arrangement, when the player leaves the gaming machine in response to the benefit information, the player stops the game play at the gaming machine. For this reason, a countermeasure for player's addiction or quasi-addiction to the game can be done while quelling players' antipathy and avoiding troubles.

The present invention makes it possible to take a countermeasure for player's addiction or quasi-addiction to games, etc., while quelling players' antipathy and avoiding troubles.

BRIEF DESCRIPTION OF THE DRAWINGS

FIG. 14A illustrates a state of storing history information.

FIG. 14B illustrates a state of storing the history information.

FIG. 15 illustrates a state of storing the history information.

DETAILED DESCRIPTION OF THE INVENTION (Outline of Information Provision System)

Figure 1:
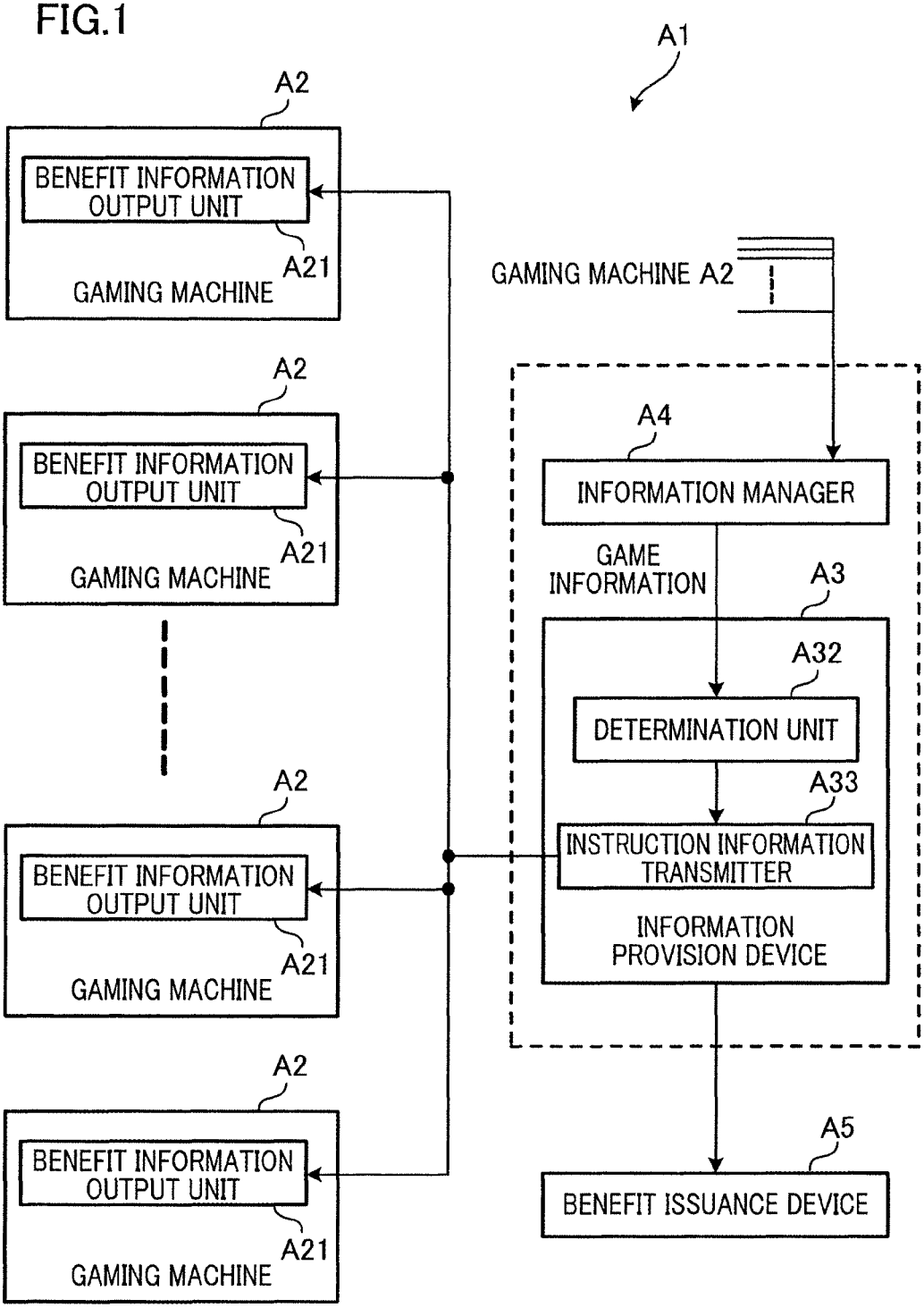
FIG. 1 illustrates the outline of an information provision system.

As shown in FIG. 1, an information provision system A1 of an embodiment is arranged to be able to execute an information provision method in which whether to take an action for a player is determined based on game information of the player who plays a game at a gaming machine A2, and when an action is taken for the player, benefit information is output to the gaming machine A2 to allow the player to acquire a particular advantage at a location different from the gaming machine A2. To be more specific, the information provision system A1 includes the gaming machine A2 which is able to run games and an information provision device A3 which is able to communicate with the gaming machine A2. The information provision device A3 includes: a determination unit A32 which determines whether to take an action for a player based on the game information of the player; and an instruction information transmitter A33 which transmits instruction information to the gaming machine A2 in order to cause the gaming machine A2 to output benefit information with which the player is able to acquire a specific advantage at a location different from the gaming machine A2, when it is determined by the determination unit A32 that the action is taken for the player.

With this arrangement, in the information provision system A1, in response to the benefit information, the player leaves the gaming machine A2 and stops the game play at the gaming machine A2. For this reason, player's obsession to the game is avoided while quelling players' antipathy and avoiding troubles. In this way, a countermeasure for player's addiction or quasi-addiction to the game is realized.

The information provision system A1 can be provided in gaming facilities such as casinos. Furthermore, the information provision system A1 can be provided in facilities such as hotels, airports, stations, shopping malls, fuel supply stations capable of supply fuels such as gasoline, restaurants, and movie theaters, and in composite facilities in which different types of facilities are gathered. The gaming facility may be a video arcade in which the gaming machine A2 is played with game points not having monetary values.

The game information may be individual information or game history of a player, or gaming values used by the player. Examples of the individual information include name, address, telephone number, nationality, passport number, and personal identification information issued by a government, etc. for specifying each player. Examples of the game history include slot machine identification information by which a slot machine which generated game history information, date and time of each game, an inserted amount when money was inserted at the start of a game, a game result (e.g., type of winning), an inserted monetary amount, a remaining amount, a payout amount, and information card identification information by which a membership information card or non-membership information card in which these sets of history information are written is specified.

A gaming value is awarded when a prize is established thanks to a game result, and is a coin, paper money, or electrically valuable information corresponding to these. The gaming value may be a gaming media such as medals, tokens, electronic money, tickets, and the like. The tickets may be barcoded tickets, etc. Alternatively, the gaming value may be a game point not including valuable information. The addiction or quasi-addiction is not limited to habit, convention, behavior disorder, mental disorder, dependency, etc., and may be a mental state close to addiction to an act or process.

The benefit information may be any types of information on condition that the information allows the player to acquire a specific advantage at a location different from the gaming machine A2. For example, the benefit information may be information indicating that a coupon attractive for the player, e.g., acquisition of a benefit in the gaming facility, is awarded to the player. The content of the benefit information is preferably changeable in accordance with, for example, the preference and/or the degree of obsession (addiction) of the player. As the benefit information corresponding to the preference of the player, information such as "Would you have a drink?" "Would you go to a movie theater?" or "Would you go to a sports gym?" is provided.

The benefit information preferably prompts the player to see a counselor. In order to prompt the player to see a counselor, for example, a benefit may be received at a counseling room, or seeing a counselor is a condition to receive a benefit. An expiration time may be set to the benefit of the benefit information in order to prompt the player to leave the gaming machine A2 for another location soon. A specific arrangement of the expiration time will be described later.

Apart from the benefit information, warning information may be output by wireless, etc. to indirectly prompt the player to leave the gaming machine A2 for another location. For example, information for warning, such as "A customer at a machine No. xx (machine ID) may become obsessed to the game" or "Please take a countermeasure for obsession for a customer at a machine No. xx", is sent to a staff member of the hall.

The information provision system A1 structured as described above includes a gaming machine A2 which is able to run games and the information provision device A3 which is able to communicate with the gaming machine A2. The information provision device A3 includes: a determination unit A32 which determines whether to take an action for a player based on the game information of the player; and an instruction information transmitter A33 which transmits instruction information to the gaming machine A2 to output, to the gaming machine A2, benefit information with which the player is able to acquire a specific advantage at a location different from the gaming machine A2, when it is determined by the determination unit A32 that the action is taken for the player.

The information provision system A1 may include an information manager A4 configured to manage game history of a player as game information, and the determination unit A32 of the information provision device A3 may determine whether to take an action for a player based on the game history. The information manager A4 will be detailed later. The information manager A4 may function as the information provision device A3. Meanwhile, the information provision device A3 may function as the information manager A4. With the arrangement above, because whether a player is addicted or quasi-addicted to the game is determined based on the game history of the player, a countermeasure for player's addiction or quasi-addiction to the game can be done without requiring the player to actively take a countermeasure.

Figure 2:
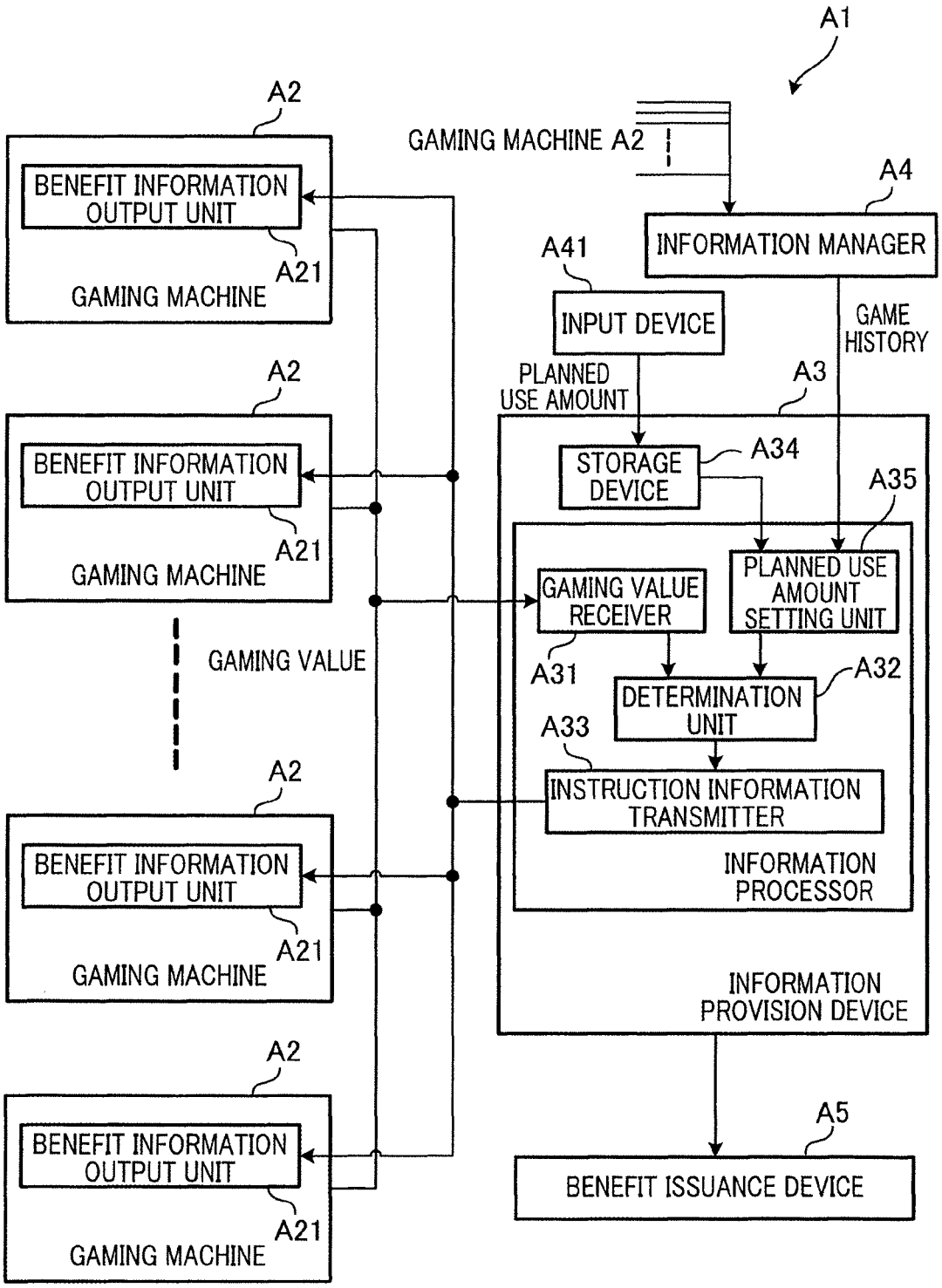
FIG. 2 illustrates the outline of an information provision system.

In addition to the above, the information provision system A1 may determine whether to take an action for a player based on a gaming value. To be more specific, as shown in FIG. 2, the information provision system A1 may be arranged such that the information provision device A3 includes a gaming value receiver A31 which receives a gaming value used by the player as game information from the gaming machine A2, and the determination unit A32 determines whether to take an action for the player based on whether the accumulated gaming value has reached a use amount.

The determination of whether the accumulated gaming value has reached the use amount may be done by the gaming machine A2 or by the information provision device A3 which is different from the gaming machine A2. The determination is preferably done by the information provision device A3 when the information provision system A1 is a large-scale system, because plural gaming machines A2 are centrally manageable. The output of the benefit information from the gaming machine A2 may be display of a moving image or a still image, output of sound, or a combination of image display and sound. The output of the benefit information may be access to a mobile device held by a player in a wireless manner.

The use amount may be a use amount set by the player, may be a use amount unique to each player and determined based on the attribute of the player such as a social status or social class, or may be a use amount which is common to all players. For example, when no input is made by the player to the input device A4 but the attribute of the player is known, a use amount determined based on the attribute is set. When no input is made and the attribute of the player is unknown, a use amount common to all players is set. In this way, obsession is prevented by setting a use amount for every player.

The information provision system A1 may determine whether to take an action for a player based on a gaming value and game history. In other words, the information provision system A1 may include an information provision device A3 which manages game history of a player as game information and the information provision device A3 may include a use amount setting unit A35 which sets a use amount based on the game history sent from the information manager A4. With the arrangement above, a countermeasure for player's addiction or quasi-addiction to the game can be taken as a use amount is set for each player based on the game history of each player.

The information provision system A1 may include an input device A41 which receives an input of a use amount from a player. In this case, because a use amount is input by the player, at which time the player is prompted to leave the gaming machine for another location can be determined by the user.

The information provision system A1 may include a benefit issuance device A5 which is provided at a location different from the gaming machine where the player plays the game. In this case, when the player leaves the gaming machine A2 for the location where the benefit issuance device A5 is provided in order to input the benefit information and receive a benefit from the benefit issuance device A5, the player has to stop playing the game at the gaming machine A2. Player's obsession to the game is therefore avoided.

When there are plural benefit issuance devices A5, the benefit may be different between the benefit issuance devices A5. In this case, types of benefits and installation locations of benefit issuance devices A5 are sent to the player as part of benefit information. The player enjoys a process of finding a benefit issuance device A5 associated with a desired benefit. Alternatively, benefits may be acquired at the respective benefit issuance devices A5, with a single set of benefit information. In this case, because the player move around the benefit issuance devices A5 to acquire benefits, a sufficient time for a change of mood is given to the player. Alternatively, the attractiveness of the benefit provided for the player by the benefit issuance device A5 may increase as the distance between the gaming machine A2 where the player plays the game and the benefit issuance device A5 increases. In this case, because the player is likely to move to a benefit issuance device A5 at a remote location, a sufficient time for a change of mood is given to the player.

Figure 3:
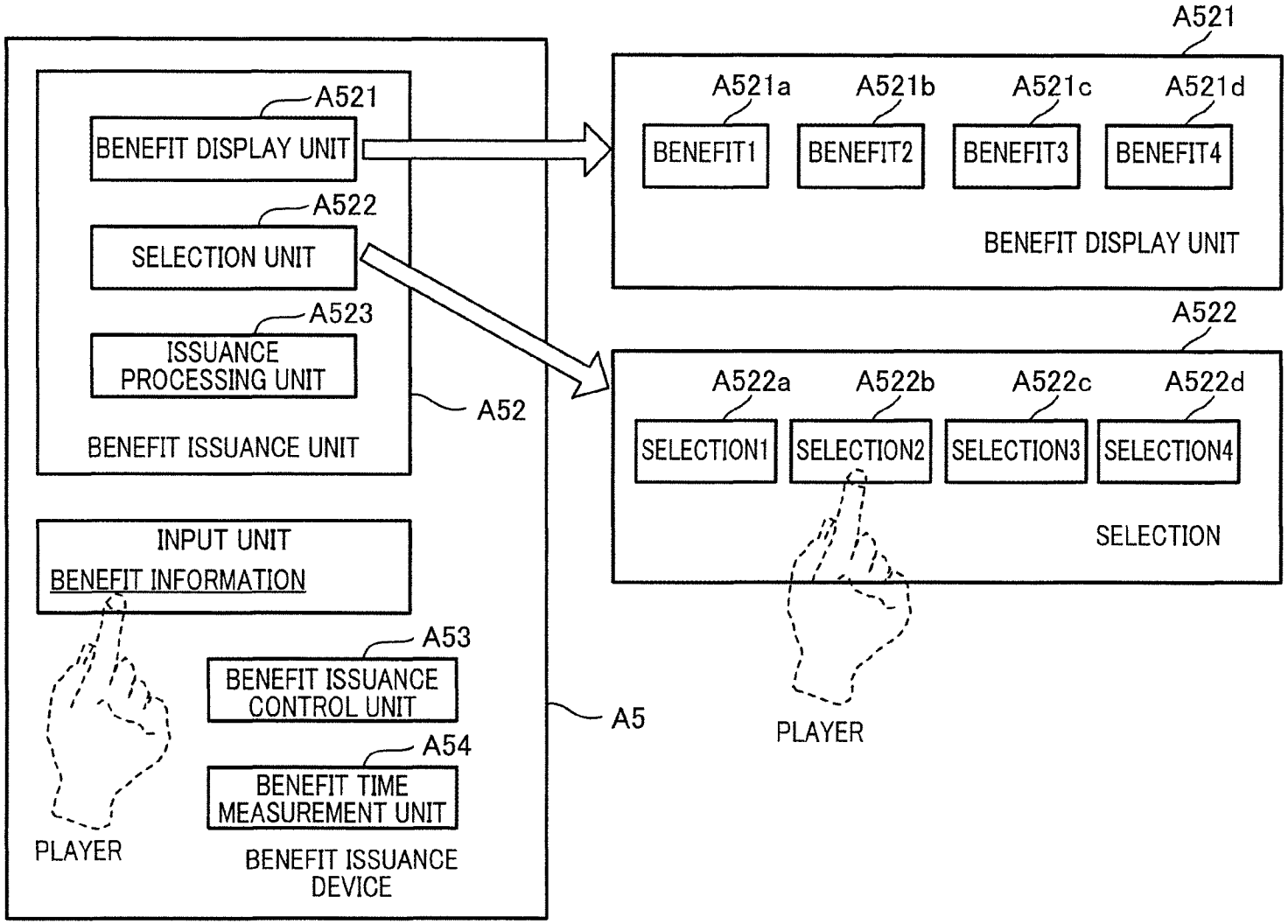
FIG. 3 illustrates a selection state of a benefit.

As shown in FIG. 3, the benefit issuance device A5 includes an input unit A51 into which benefit information is input by the player and a benefit issuance unit A52 which issues a benefit associated with the benefit information. The benefit issuance unit A52 may issue a single type of benefit or plural types of benefits.

When issuing plural types of benefits, the benefit issuance unit A52 includes a benefit display unit A521 which displays plural types of benefits associated with benefit information, a selection unit A522 which allows a player to select one of plural types of benefits A521*a* to A521*d* displayed by the benefit display unit A521, and an issuance processing unit A523 which issues one of the benefits A521*a* to A521*d* selected by the selection unit. The selection unit A522 has plural selection buttons A522*a* to A522*d*. The selection buttons A522*a* to A522*d* are associated with the respective benefits A521*a* to A521*d* of the benefit display unit A521, and one of the benefits A521*a* to A521*d* is selected as the player presses the associated button. With this arrangement, because the player is more likely to acquire a desired benefit as the plural types of benefits A521*a* to A521*d* are selectable, the player is more likely to acquire an advantage at a location different from the gaming machine A2.

The benefit issuance device A5 may include a time measurement unit A54 which measures the time elapsed from output of benefit information from the gaming machine A2 to an input to the input unit A51 by the player and a benefit issuance control unit A53 which causes the benefit issuance unit to issue a benefit when the expiration time has not arrived. With this arrangement, because the expiration time is set for the issuance of benefit, the player is motivated to leave the gaming machine A2 early.

As shown in FIG. 2, the information provision device A3 may include a storage device A34 which stores a use amount of gaming value. That is to say, the information provision device A3 includes the storage device A34 which stores a use amount of gaming value and an information processor A30 which is able to communicate with the gaming machine A2 where a game is playable, and the information processor A30 includes the gaming value receiver A31 which receives game information of the gaming value used by the player from the gaming machine A2, the determination unit A32 which determines whether the accumulated amount indicated by the game information has reached the use amount, and the instruction information transmitter A33 which, when the determination unit A32 determines that the accumulated amount indicated by the game information has reached the use amount, transmits instruction information to the gaming machine A2 to cause the gaming machine A2 to output benefit information which notifies the player that he/she is able to acquire a specific advantage at a location different from the gaming machine A2. With this arrangement, the information provision method by which obsession to the game is avoided is realized only by providing the information provision device A3 in the information provision system A1.

In the information processor A30, the information provision method may be embodied by hardware or software. The software is an information provision program which, in order to cause the player at the gaming machine A2 to stop playing the game, causes the information processor A30 to have a function of acquiring game information of the player playing at each gaming machine A2, a function of determining whether to take an action for the player based on the game information, and a function of, when an action is taken for the player, causing the gaming machine A2 to output benefit information to allow the player to acquire a specific advantage at a location different from the gaming machine A2. The information provision program may be distributed through wires or by wireless, or may be stored in recording media and distributed.

Figure 4:
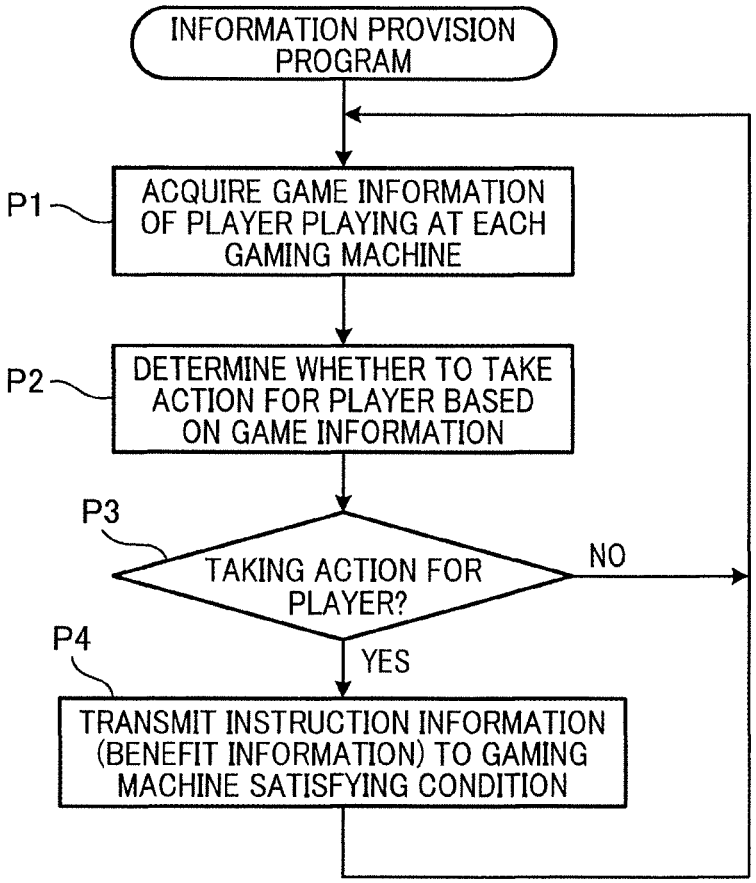
FIG. 4 illustrates the outline of an information provision system.

The information provision program will be specifically described with reference to FIG. 4. Game information of a player playing at each gaming machine A2 is acquired (P1), whether to take an action for the player is determined based on the game information (P2), and if no action is taken for the player (NO in P3), the program is run again from P1. If an action is taken for the player (YES in P3), instruction information (benefit information) is transmitted to the gaming machine A2 satisfying the condition, i.e., to the gaming machine A2 where the player who is addicted or quasi-addicted to the game plays the game (P4) so as to cause the gaming machine A2 to output benefit information.

(Example of Application of Information Provision System: Game System 1)

Figure 5:
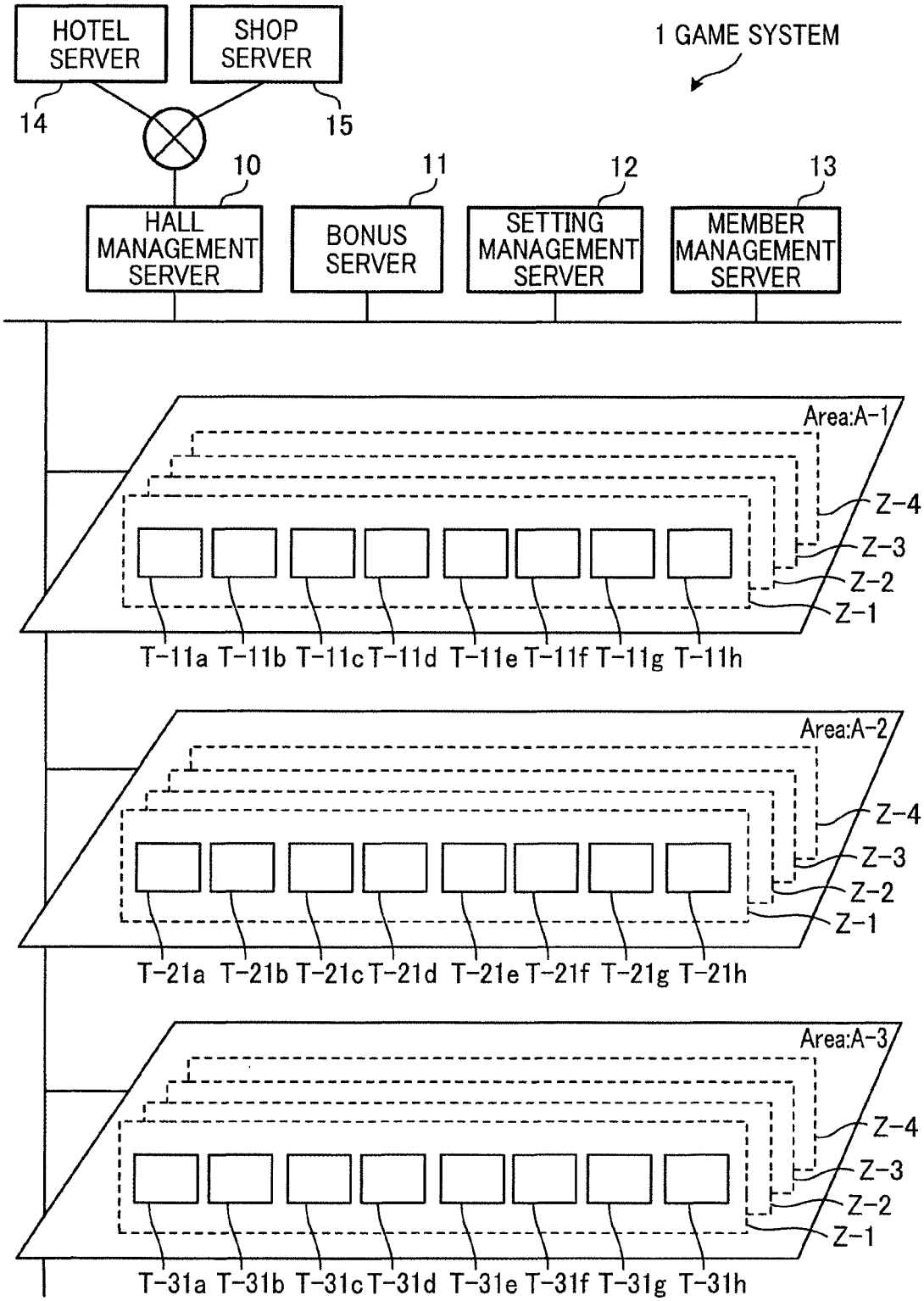
FIG. 5 is a flowchart of an information provision method.

A game system 1 to which the information provision system A1 is applied will be described with reference to FIG. 5. FIG. 5 is a schematic drawing of the overall structure of the game system 1. The game system 1 includes a hall management server 10, a bonus server 11, a setting management server 12, a member management server 13, a hotel server 14, a shop server 15, the gaming machine A2 shown in FIG. 1, a service terminal which is a benefit issuance device 5, and a signage which is an input device 4.

The number of each device is suitably determined. The number of each device may be one or plural, for example. When a function of one device can be fulfilled by another device, the one device may not be provided, for example.

The hall management server 10 adds up and manages all flows of money in the hall (gaming facility), generates a balance sheet, etc., and manages other servers. Furthermore, the hall management server 10 acquires and stores game information which includes a timing when the gaming machine starts a unit game, a timing to end the unit game, and a result of random determination in the unit game. The hall management server 10 has a function of the information provision device A3 shown in FIG. 1.

The hall management server 10 inquires of the hotel server 14 information such as vacant rooms and free services, and stores vacant room information (information of available rooms, such as the size of each room, the number of beds in each room, the number of nights, accommodation charge, etc.) and free meal information. Furthermore, the hall management server 10 inquires of the shop server 15 information such as vacant seats, available coupons, a bargain sale for a limited period, etc., and the hall management server 10 stores vacancy information, coupon information, event information, and bargain sale information.

The bonus server 11 controls bonus random determination in a bonus game and a synchronous effect which is performed in relation to the bonus random determination. Furthermore, the bonus server 11 manages an accumulated value for awarding a bonus (e.g., credits accumulated for a progressive bonus). The setting management server 12 stores and manages settings related to a gaming machine which is a target of bonus random determination and a synchronous effect.

The member management server 13 is a server which is used to store and manage information such as the individual information of a member, the information of a member card (IC card), and a past game result of the member. A member card (IC card) is issued by, for example, a member card issuance terminal. Individual information of a member which is input at the time of registration is stored in a member management server 13 together with the identification code of the member card. The member card issuance terminal is provided with a camera, and the face of a player who receives an IC card is photographed at the time of the issuance of the member card. The photographed image is stored in the member management server 13 in association with an identification code.

Gaming equipment constituted by gaming machines, service terminals, and signages is provided in plural areas (e.g., A-1 to A-3). Each of these areas is, for example, a floor in a hall or an area in a floor. While there are the areas A-1 to A-3 in the present embodiment, the disclosure is not limited to this arrangement.

The gaming equipment is provided in zones (e.g., Z-1 to Z-4) in an area. Each zone corresponds to a specific space in the area. While there are four zones (Z-1 to Z-4) in each area in the present embodiment, the disclosure is not limited to this arrangement. Furthermore, while eight devices are provided in each zone in the present embodiment, the disclosure is not limited to this arrangement.

The gaming equipment is connected to members such as the hall management server 10 and the bonus server 11 by LAN using Ethernet (registered trademark) as schematically shown in the figures. The connection states will be detailed later.

Each devices for game has a unique identifier, and the hall management server 10, etc. identifies a sender of data by means of an identifier. When data is transmitted from the hall management server 10, etc. to a device for game, the target is specified based on the identifier. The identifier is, for example, a network address such as IP address. Alternatively, gaming machines may be managed by using identifiers which are not network addresses.

Note that the game system 1 may be installed in one hall (gaming facility) where various games take place, or between a plurality of halls. When the game system 1 is constructed in a single hall, the system may be constructed in each floor or section of the hall. The communication line connecting the server with the gaming equipment may be wires or wireless, and can adopt a dedicated line, an exchange line or the like.

(Specific Example of Information Provision System)

Figure 6:
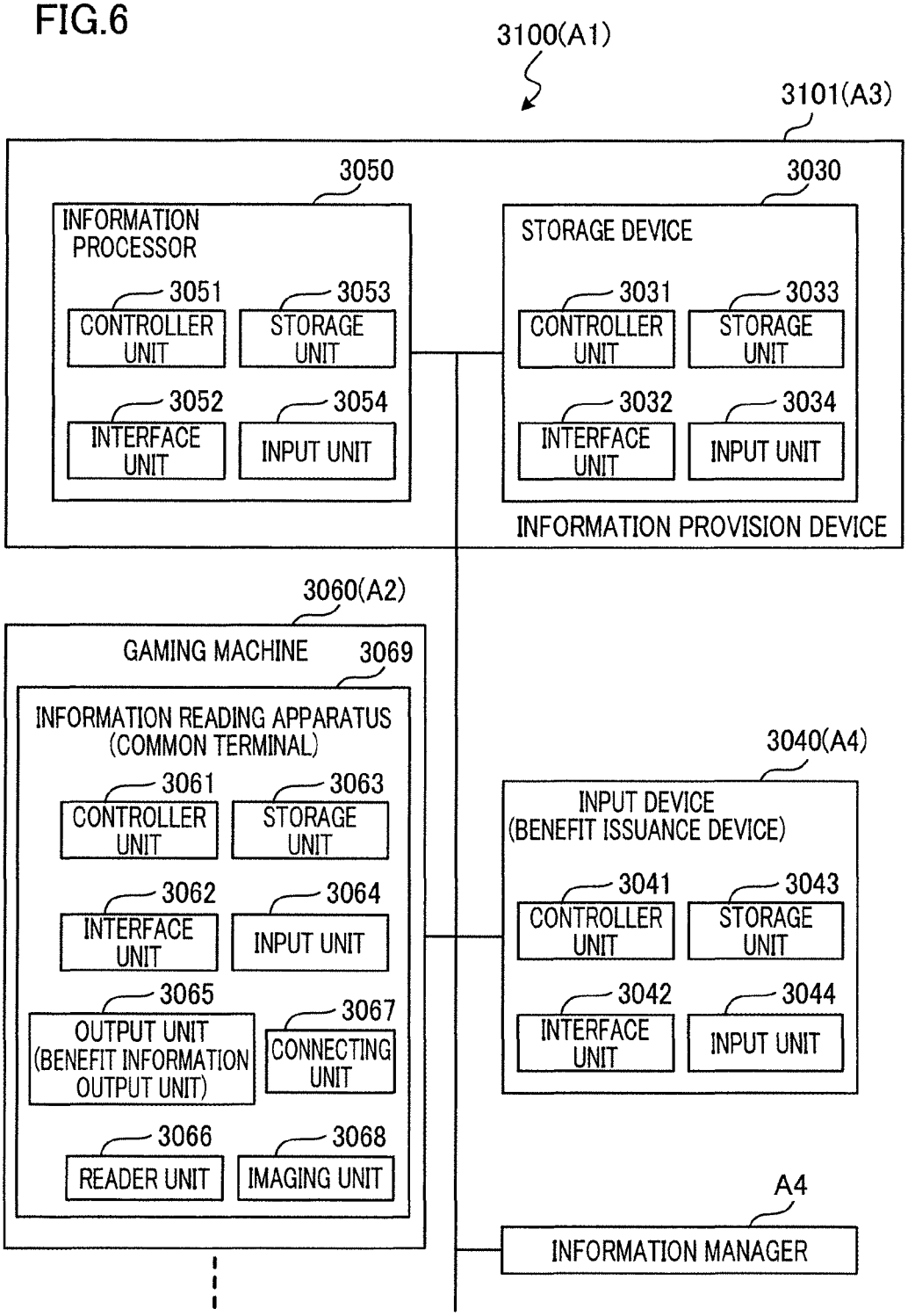
FIG. 6 illustrates the structure of a game system.

The following will specifically describe the structure of the information provision system A1 with reference to FIG. 6. The information provision system A1 includes an information provision device 3101 (A3), gaming machines 3060 (A2), an input device 3040 (A4), and an information manager A4. The input device 3040 may function as the benefit issuance device A5. The information provision device 3101 includes an information processor 3050 and a storage device 3030.

(Specific Example of Information Provision System: Information Provision Device 3101: Information Processor 3050)

The information processor 3050 includes a controller unit 3051, an interface unit 3052, a storage unit 3053, and an input unit 3054.

The controller unit 3051 is arranged to be able to control the interface unit 3052 and the storage unit 3053. The controller unit 3051 determines whether a predetermined condition is satisfied. When the predetermined condition is satisfied, the controller unit 3051 is able to execute a process of, for example, causing a notification device (e.g., a gaming machine 3060) to notify information regarding obsession prevention. In other words, the controller unit 3051 realizes a function of the determination unit A32 shown in FIG. 1. Alternatively, a display unit such as a display may be provided, and a display control unit capable of controlling image display on the display unit may be provided in addition to the controller unit 3051. A CPU (Central Processing Unit), an MCU (Micro-Control Unit), a motherboard, a GPU (Graphics Processing Unit), and/or a video card (graphic board) functions as the controller unit 3051, for example.

The interface unit 3052 is arranged to be able to communicate with devices connected to the network. Communication devices (e.g., wired LAN, wireless LAN, and a communication module of mobile phone network) for wired and wireless communications function as the interface unit 3052, for example. The interface unit 3052 functions as the gaming value receiver A31 and the instruction information transmitter A33 shown in FIG. 2.

The storage unit 3053 is able to store various types of information (e.g., programs and tables for controlling the information provision system 3100). A ROM (Read Only Memory), a RAM (Random Access Memory), a silicon disc, and/or hard disk functions as the storage unit 3053, for example. For example, functions of the information processor 3050 are realized in such a way that a program, table data, etc. stored in the ROM are read by the CPU to the RAM and executed.

The input unit 3054 is arranged to be able to input various types of information into the information processor 3050 in response to inputs from the user. Members functioning as the input unit 3054 include an input/output interface such as a USB terminal, a physical button, a physical keyboard, a mouse, and a user interface displayed on a liquid crystal touch panel.

The storage device 3030 may be omitted and the information processor 3050 may function as the storage device 3030.

(Specific Example of Information Provision System: Information Provision Device 3101: Storage Device 3030)

The storage device 3030 realizes a function of the storage device A34 shown in FIG. 2 and includes a controller unit 3031, an interface unit 3032, a storage unit 3033, and an input unit 3034. The controller unit 3031 is arranged to be able to control the interface unit 3032, the storage unit 3033, and the input unit 3034. The controller unit 3031 is arranged to be able to execute processes such as a process of storing, in the storage unit 3033, information (e.g., game information) received through the interface unit 3032. A CPU (Central Processing Unit), an MCU (Micro-Control Unit), a motherboard, or the like functions as the controller unit 3031.

The interface unit 3032 is arranged to be able to communicate with devices connected to the network. Communication devices (e.g., wired LAN, wireless LAN, and a communication module of mobile phone network) for wired and wireless communications function as the interface unit 3032, for example.

The storage unit 3033 is able to store various types of information (e.g., programs and tables for controlling the information provision system 3100). A ROM (Read Only Memory), a RAM (Random Access Memory), a silicon disc, and/or hard disk functions as the storage unit 3033, for example. For example, functions of the storage device 3030 are realized in such a way that a program, table data, etc. stored in the ROM are read by the CPU to the RAM and executed.

The input unit 3034 is arranged to be able to input various types of information into the storage device 3030 in response to inputs from the user. Members functioning as the input unit 3034 include an input/output interface such as a USB terminal, a physical button, a physical keyboard, a mouse, and a user interface provided on a liquid crystal touch panel.

The storage device 3030 is, for example, a database server capable of storing various types of information. The storage device 3030 transmits data to each of the input device 3040, the information processor 3050, and the gaming machine 3060 in response to a request therefrom, and stores, rewrites, or deletes data in response to a request therefrom.

(Specific Example of Information Provision System: Input Device 3040)

The input device 3040 realizes a function of the input device A4 shown in FIG. 2 and includes a controller unit 3041, an interface unit 3042, a storage unit 3043, and an input unit 3044.

The controller unit 3041 is arranged to be able to control the interface unit 3042, the storage unit 3043, and the input unit 3044. The controller unit 3041 is arranged to be able to execute processes such as a process of transmitting, to the storage device 3030, information input through the input unit 3044. Alternatively, a display unit such as a display may be provided, and a display control unit capable of controlling image display on the display unit may be provided in addition to the controller unit 3041.

A CPU (Central Processing Unit), an MCU (Micro-Control Unit), a motherboard, a GPU (Graphics Processing Unit), and/or a video card (graphic board) functions as the controller unit 3041, for example.

The interface unit 3042 is arranged to be able to communicate with devices connected to the network. Communication devices (e.g., wired LAN, wireless LAN, and a communication module of mobile phone network) for wired and wireless communications function as the interface unit 3042, for example.

The storage unit 3043 is able to store various types of information (e.g., programs and tables for controlling the information provision system 3100). A ROM (Read Only Memory), a RAM (Random Access Memory), a silicon disc, and/or hard disk functions as the storage unit 3043, for example. For example, functions of the input device 3040 are realized in such a way that a program, table data, etc. stored in the ROM are read by the CPU to the RAM and executed.

The input unit 3044 is arranged to be able to input various types of information into the input device 3040 in response to inputs from the user. Members functioning as the input unit 3044 include an input/output interface such as a USB terminal, a physical button, a physical keyboard, a mouse, and a user interface provided on a liquid crystal touch panel. The input unit 3044 converts finger movements of a person to specific digital signals (input information) through a mouse, keyboard, a liquid crystal touch panel, etc.

The input device 3040 is, for example, a service terminal or a signage to which various types of information can be input. The details of the service terminal and the signage will be given later. The input device 3040 transmits input information (e.g., consumption amount per day) input by the input unit 3044 to the storage device 3030 through the interface unit 3042. Upon receiving input information, the storage device 3030 stores the information in a predetermined storage area of the storage unit 3033.

(Specific Example of Information Provision System: Information Manager A4)

Figure 7:
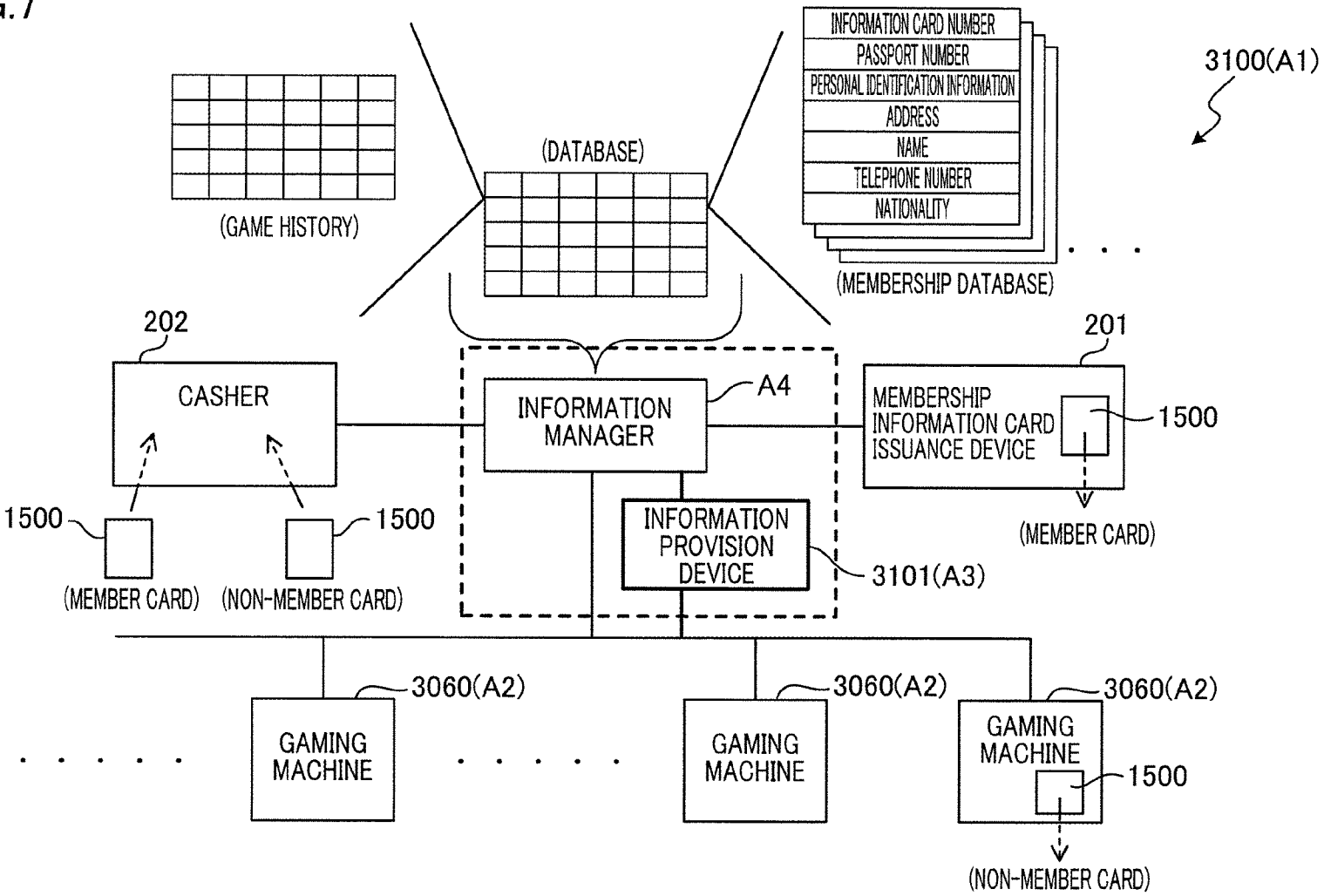
FIG. 7 illustrates the outline of the information provision system.

The following details the information manager A4 with reference to FIG. 7. FIG. 7 is a block diagram of an information management system 100 of an embodiment of the present invention. As shown in FIG. 1, the information management system 100 includes gaming machines 3060 (A2) provided in a gaming hall such as a casino, an information manager A4 connected to the gaming machines 3060 to be able bi-directionally communicate therewith, and an information provision device A3. While in the present embodiment communications between the gaming machines 3060 which are slot machines and the information manager A4 are carried out through a PTS terminal 1700 provided in each gaming machine 3060, each gaming machine 3060 may directly communicate with the information manager A4.

The information manager A4 is connected to a membership information card issuance device 201. An IC card 1500 is issued by this membership information card issuance device 201 as a membership information card. The membership information card stores unique information card identification information (information card number) used for specifying the IC card 1500. The information manager A4 stores membership information in a membership database in association with each information card number. A player who wants to be a member registers individual information in the membership database as membership information. In the membership database, the individual information is registered in association with information card identification information (information card number) which specifies an information card.

The information card to which an information card number is assigned is issued by the membership information card issuance device 201, and is used when the registered player plays a game at a gaming machine 3060.

The information manager A4 is further connected to a casher 202 by which conversion into money is performed based on the IC card 1500 (membership information card or non-membership information card). After a game, a player who played the game by using an IC card 1500 which is a membership information card or a non-membership information card receives the IC card 1500 ejected from the gaming machine 3060 and inserts the IC card 1500 into a card reader of the casher 202, so that money corresponding the remaining amount owned by the player associated with the information card identification information (information card number) of the IC card 1500 is paid out to the player. In the present embodiment, information of the remaining amount associated with the information card (IC card) is directly written into the IC card 1500. Alternatively, for example, the remaining amount may be stored in the information manager A4 in association with the information card number. In this case, remaining amount information stored in a memory of the information manager A4 in association with the card number of the IC card 1500 read by the card reader of the casher 202 is read out, and money is paid out based on this information.

When a player who is not a member inserts money into a gaming machine 3060 and plays a game, an amount corresponding to a payout awarded to the player as a result of the game and a remaining credit amount after betting is written into a non-membership information card (IC card 1500), and the non-membership information card is newly given to the player from the gaming machine 3060 where the player played the game. The player is allowed to insert this new non-membership information card (IC card 1500) into another gaming machine 3060 and play another game by using a credit amount corresponding to the remaining amount rewritten in the non-membership information card. When a game is played with a non-membership information card (IC card 1500) inserted in a gaming machine 3060, a gaming value (equivalent to a currency amount, credit amount, etc.) based on a credit amount such as a payout awarded as a result of the game play is written into the non-membership information card (IC card 1500) inserted in the gaming machine 3060 for playing the game. In other words, the remaining amount stored in the non-membership information card is updated and the non-membership information card is returned. In this way, a player who is not a member is allowed to play games at different gaming machines 3060 with one non-membership information card.

Also when an inserted IC card 1500 is a membership information card issued for a registered player, the remaining amount in the inserted membership information card is similarly updated and paid out.

(Specific Example of Information Provision System: Gaming Machine 3060)

The gaming machine 3060 includes an information reading apparatus 3069.

The information reading apparatus 3069 includes a controller unit 3061, an interface unit 3062, a storage unit 3063, an input unit 3064, an output unit 3065, a reader unit 3066, a connection unit 3067, and an imaging unit 3068.

The controller unit 3061 is arranged to be able to control the other components 3062 to 3068. A CPU, an MCU, a motherboard, a GPU, and/or a video card (graphic board) functions as the controller unit 3061, for example. Alternatively, a display control unit capable of controlling image display on the output unit 3065 such as a display may be provided in addition to the controller unit 3061.

The interface unit 3062 is arranged to be able to communicate with devices connected to the network. Communication devices (e.g., wired LAN, wireless LAN, and a communication module of mobile phone network) for wired and wireless communications function as the interface unit 3062, for example.

The storage unit 3063 is able to store various types of information. A ROM, a RAM, a silicon disc, and/or hard disk functions as the storage unit 3063, for example.

The input unit 3064 has a function of a benefit information output unit A21 shown in FIG. 2 and allows the user to input various types of information into the information reading apparatus 3069. Members functioning as the input unit 3064 include an input/output interface such as a USB terminal, a physical button, a physical keyboard, a mouse, and a user interface displayed on a liquid crystal touch panel.

The output unit 3065 is arranged to be able to output various types of information (regarding prevention of obsession) received through the interface unit 3062. Members functioning as the output unit 3065 include a display such as a liquid crystal display device, a light emitter such as an LED (Light Emitting Diode), a speaker outputting sound and voice, and a vibration generator such as a motor which generates vibration.

The reader unit 3066 is arranged to be able to read, for example, identification information which is stored in a recording medium (e.g., an IC card) and by which a user can be identified. Members functioning as the reader unit 3066 include a contact-type reader-writer and a contactless reader-writer.

The connection unit 3067 is arranged to be able to communicate with a gaming machine. Members functioning as the connection unit 3067 include a communication device (USB, expansion slot, network terminal, etc.) performing wired communications and/or wireless communications. The imaging unit 3068 is arranged to be able to take a video and/or image of a place where the information reading apparatus 3069 is installed. For example, a CCD image sensor functions as the imaging unit 3068.

The input device 3040 may be omitted and the gaming machine 3060 may function as the input device 3040.

(Specific Example of Information Provision System: Outline of Gaming Machine (Slot Machine))

Figure 8:
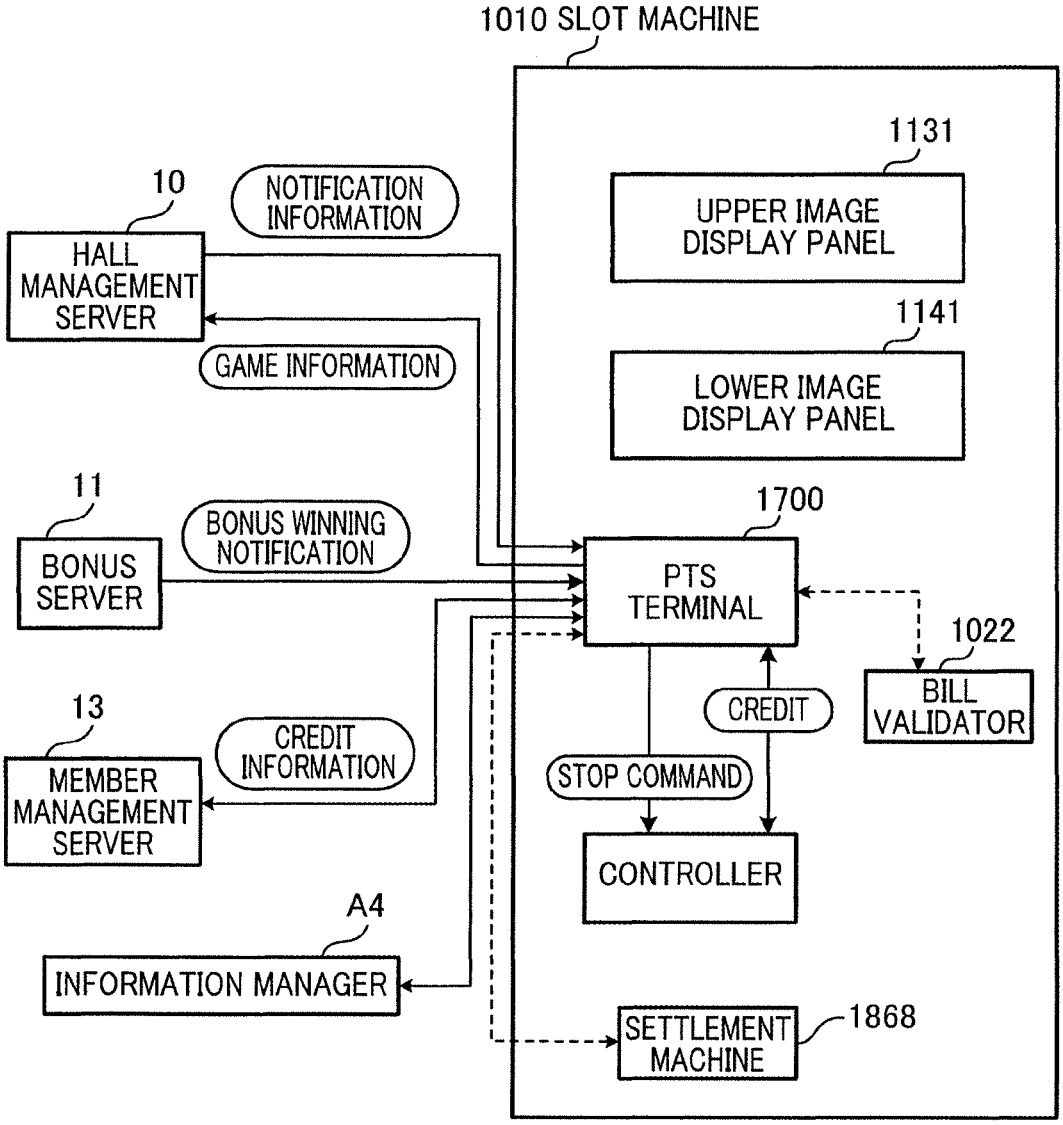
FIG. 8 illustrates the outline of a slot machine.

A gaming machine of an embodiment of the present invention will be detailed with reference to FIG. 8. FIG. 8 conceptually shows the structure of a slot machine 1010 which is a gaming machine integrated with a player tracking device. The player tracking device is a terminal for realizing a player tracking system. Hereinafter, this device will be referred to as a PTS terminal in this specification. While the descriptions below assume that a slot machine is used as a gaming machine, the disclosure is applicable not only to slot machines but also to gaming machines running various games.

The slot machine 1010 includes a PTS terminal 1700 and a settlement machine 1868. The slot machine 1010 is connected to members such as a hall management server 10, a bonus server 11, a member management server 13, and an information manager A4 through the PTS terminal 1700 and over a network. In the present embodiment, one PTS terminal 1700 is provided at a part of a housing of one slot machine 1010.

The PTS terminal 1700 is connected to a bill validator 1022 through a communication line (or the slot machine 1010). The PTS terminal 1700 sends and receives data to and from a controller (a later-described controller 1100 of the slot machine 1010) under a predetermined protocol and performs data communications with members such as the hall management server 10 and the bonus server 11, which are connected to the PTS terminal 1700 over a network. For example, from the PTS terminal 1700 to the controller, information of a credit required to start a game, a stop command which instructs the stop of a unit game when a synchronized effect is performed, etc. are transmitted. From the controller to the PTS terminal 1700, information of a credit as a game result, a notification to start the unit, an end notification, etc. are transmitted.

From the PTS terminal 1700 to the hall management server 10, a notification of insertion or ejection of a member card, a notification of start or end of the unit game, game information such as a random determination result, bet information, and a payout amount, etc. are transmitted. Meanwhile, from the hall management server 10 to the PTS terminal 1700, instruction information for performing notification of information regarding obsession prevention is transmitted. Upon receiving instruction information, the PTS terminal 1700 performs notification of benefit information which contributes to obsession prevention.

From the bonus server 11 to the PTS terminal 1700 (of a predetermined slot machine 1010), a bonus winning notification is transmitted. Furthermore, information regarding a credit owned by a member, etc. is exchanged between the PTS terminal 1700 and the member management server 13.

A flow of a game for a member will be outlined. To begin with, membership registration is performed at a member card issuance terminal, and a member card (IC card) is accordingly issued. Thereafter, the player inserts the member card into the PTS terminal 1700 of the slot machine 1010, and inserts money. When a banknote is inserted, the bill validator 1022 identifies a money type and a monetary amount, and money type data and monetary amount data are transmitted to the PTS terminal 1700 as results of identification. The PTS terminal 1700 calculates a credit for game based on the money type data and the monetary amount data, and transmits the credit to the controller.

The controller runs a game based on the credit transmitted from the PTS terminal 1700. A credit corresponding to a game result is transmitted from the controller to the PTS terminal 1700, and the PTS terminal 1700 calculates a payout based on the game result and determines a monetary amount paid out to the player. The PTS terminal 1700 writes the determined monetary amount directly into the member card, and ejects the member card. To the member card, a predetermined point is awarded in accordance with the execution of games, etc.

When the player who is the member plays a game next time, the PTS terminal 1700 reads a monetary amount stored in the inserted member card. The monetary amount read out from the member card is converted to a credit and transmitted to the controller. Being similar to the above, a credit corresponding to a game result is transmitted from the controller to the PTS terminal 1700, and the PTS terminal 1700 calculates a payout based on the game result and determines a monetary amount paid out to the player. At this stage, the monetary amount in the member card is updated in such a way that the monetary amount acquired as a result of the game is added to the monetary amount stored in the member card.

At this stage, furthermore, the PTS terminal 1700 transmits the identification code (or player identification code) read from the member card and the updated monetary amount to the member management server 13, and the member management server 13 adds the monetary amount transmitted from the PTS terminal 1700 to the monetary amount owned by the member specified by the identification code, and stores the updated monetary amount. By this process, the monetary amount owned by the member is always managed.

At a casher counter, etc., the player who is the member is able to perform settlement based on the monetary amount stored in the member card according to need. When the settlement machine 1868 is available as in the above-described slot machine 1010, settlement by using the member card can be done at the slot machine 1010.

Meanwhile, the outline of a flow of a game for a non-member is as below. A player inserts money into the PTS terminal 1700 of the slot machine 1010. When a banknote is inserted, the bill validator 1022 identifies a money type and a monetary amount, and money type data and monetary amount data are transmitted to the PTS terminal 1700 as results of identification. The PTS terminal 1700 calculates a credit for game based on the money type data and the monetary amount data, and transmits the credit to the controller.

The controller runs a game based on the credit transmitted from the PTS terminal 1700. A credit corresponding to a game result is transmitted from the controller to the PTS terminal 1700, and the PTS terminal 1700 calculates a payout based on the game result and determines a monetary amount paid out to the player. The PTS terminal 1700 writes the determined monetary amount into a new IC card accommodated in the slot machine 1010, and ejects the IC card. The non-member acquires the IC card for the first time at this stage.

At a casher counter, etc., the player who is the non-member is able to perform settlement based on the monetary amount stored in the IC card according to need. When the settlement machine 1868 is available as in the above-described slot machine 1010, settlement by using the IC card can be done at the slot machine 1010.

(Specific Example of Information Provision System: External Appearance of Gaming Machine (Slot Machine))

Figure 9:
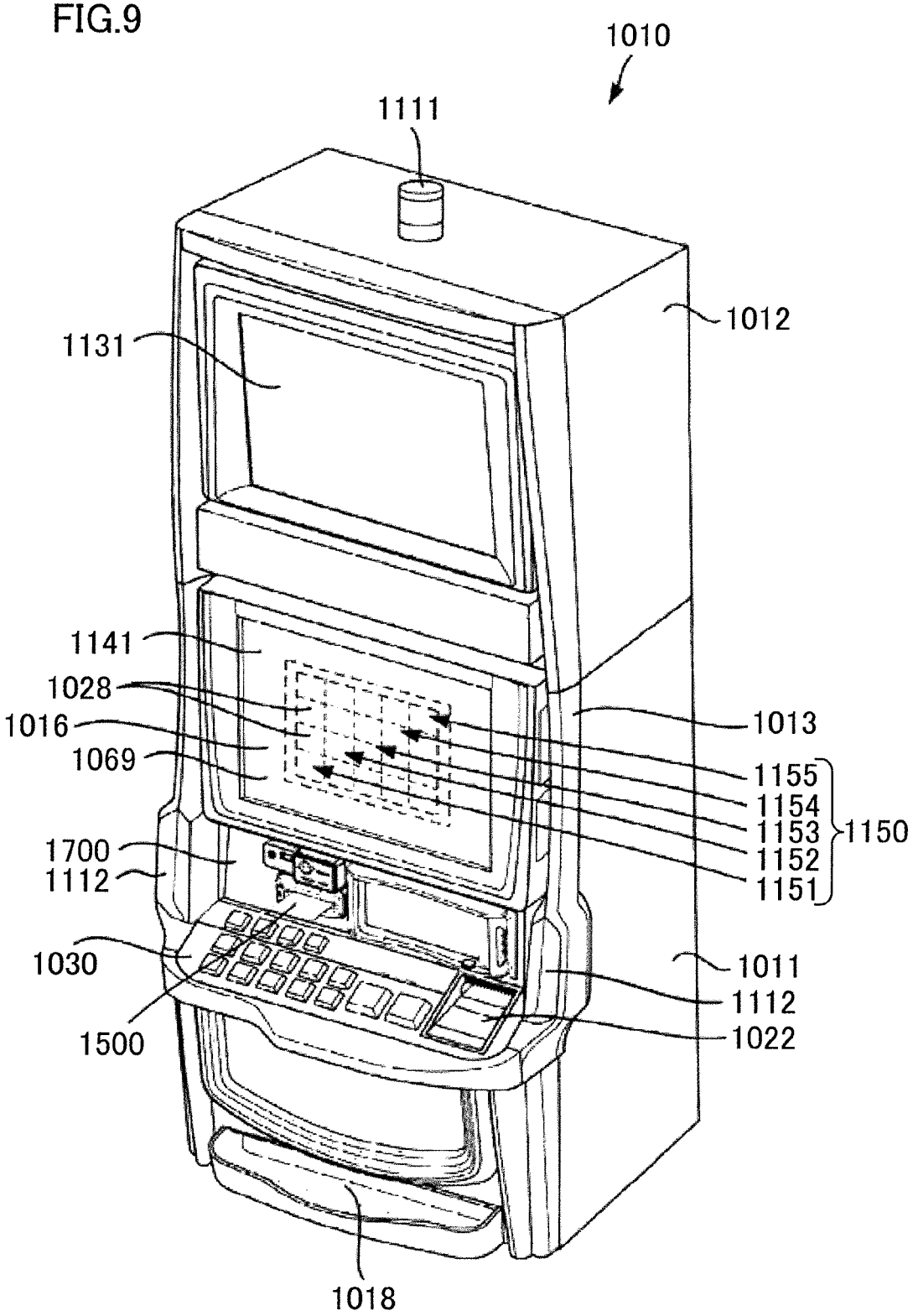
FIG. 9 is a perspective view of the slot machine.

Referring to FIG. 9, the external appearance of the slot machine 1010 will be described.

In the slot machine 1010, a member card (IC card), a banknote, or electrically valuable information corresponding to these is used as a gaming medium. In the present embodiment, in particular, credit-related data such as cash data stored in an IC card 1500 is used.

The slot machine 1010 includes a cabinet 1011, a top box 1012 installed on the upper side of the cabinet 1011, and a main door 1013 provided at the front surface of the cabinet 1011.

A symbol display device 1016 is disposed in the main door 1013, which is termed a lower image display panel 1141. The symbol display device 1016 is formed by a transparent liquid crystal panel. In a screen displayed on the symbol display device 1016, a display window 1150 is provided at a central portion. The display window 1150 is constituted of 20 display blocks 1028 forming 5 columns and 4 rows. Each column composed of 4 display blocks 1028 forms each of simulated reels 1151 to 1155, which rotate according to an input by the player. On each of the simulated reels 1151 to 1155, the 4 display blocks 1028 move downward with overall changes in speed, so that symbols 1501 on the display blocks 1028 are vertically rotated and then stopped, in other words, the symbols are rearranged.

The term "rearrangement" indicates that the symbols 1501 are rearranged after the arrangement of the symbols 1501 is dismissed. The term "arrangement" indicates a state in which the symbols 1501 are visually recognizable by an external player. A so-called slot game is run by the slot machine 1010 according to the state of the arrangement of the symbols 1501 when the rotated simulated reels 1151 to 1155 stop, and a payout corresponding to a winning combination is paid to the player.

While in the present embodiment the slot machines 1010 are so-called video slot machines, some mechanical reels in a slot machine 1010 of the present invention may be replaced by the simulated reels 1151 to 1155.

In addition to the above, a touch panel 1069 is disposed on the front surface of the symbol display device 1016, and the player may input various instructions by operating the touch panel 1069. Input signals are sent from the touch panel 1069 to the main CPU.

An upper image display panel 1131 is provided at the front face of the top box 1012. The upper image display panel 1131 includes a liquid crystal panel, and forms the display. The upper image display panel 1131 displays images related to effects and images showing introduction to the game contents and explanation of the game rules. Further, the top box 1012 is provided with a lamp 1111.

In addition, a credit amount display unit (not shown) is displayed above the display window 1150 to display a current credit amount. Wherein, the "credit" refers to a virtual gaming medium used when a player places a bet. The credit amount display unit displays a total credit amount currently owned by a player.

In addition to the above, a broken number cash display unit (not shown) is displayed below the credit amount display unit. The broken number cash display unit displays broken number cash. The "broken number cash" indicates cash which cannot be converted to a credit due to the shortage of an inserted monetary amount.

At least one of the lower image display panel 1141 or the upper image display panel 1131 has a function of the benefit information output unit A21 shown in FIG. 1, and displays benefit information for a player to indicate that the player is able to acquire a specific advantage at a location different from the slot machine 1010.

The IC card 1500 is inserted into the PTS terminal 1700, the credit amount display unit displays a credit amount stored in the IC card, and the broken number cash display unit displays broken number cash stored in the IC card. These values are stored in the member management server 13 in association with the identification code of the member card.

The IC card 1500 is a contactless IC card in which an IC (Integrated Circuit) used for storing and calculating various data such as a credit is embedded, and the IC card 1500 is able to perform short distance wireless communication such as an NFC (Near Field Communication) based on the RFID (Radio Frequency Identification) technology. A player is able to own credit-related data by using the IC card 1500 and to carry the IC card 1500 between different slot machines. Furthermore, as the IC card 1500 is inserted into the PTS terminal 1700 of the slot machine 1010, the player is able to play games such as a unit game at the slot machine 1010 by using credit-related data (monetary amount data) stored in the IC card 1500. The IC card 1500 may store data of a use amount which is unique to each player.

In addition to the above, below the lower image display panel 1141, the PTS terminal 1700 is embedded in the cabinet 1011. Speakers 1112 are provided to the left of and to the right of the PTS terminal 1700. The speakers 1112 have a function of the benefit information output unit A21 shown in FIG. 1, and output, by sound, benefit information for a player to indicate that the player is able to acquire a specific advantage at a location different from the slot machine 1010. In this way, in the slot machine 1010, effects of the unit game are executed and the benefit information is notified to the player, by image display on the upper image display panel 1131, sound output from the speakers 1112, light emission from the lamp 1111, etc.

(Specific Example of Information Provision System: External Appearance of PTS Terminal)

Figure 10:
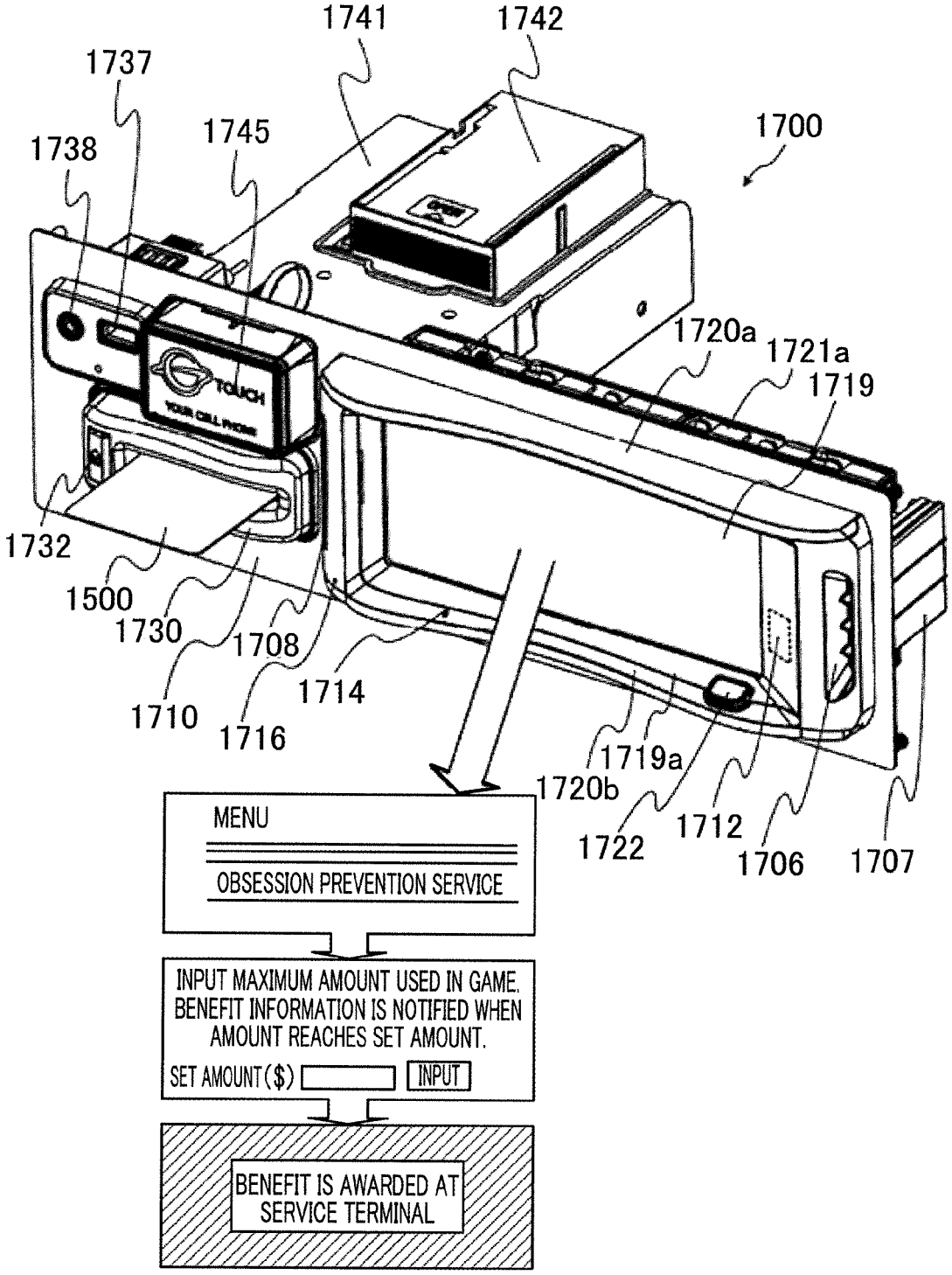
FIG. 10 is a perspective view of a PTS terminal.

FIG. 10 is a perspective view representing the PTS terminal 1700 disposed in the slot machine 1010. The PTS terminal 1700 has a function of the benefit information output unit A21 shown in FIG. 1, i.e., a function of outputting benefit information for a player to indicate that the player is able to acquire a specific advantage at a location different from the slot machine 1010. Furthermore, the PTS terminal 1700 preferably has a function of the input device A4 shown in FIG. 1, i.e., receiving an input of use amount from a player. For example, a menu screen is displayed on an LCD 1719 at the start of a game when the IC card 1500 is set, and the screen is switched to a use amount screen when the player selects "OBSESSION PREVENTION SERVICE". On the use amount screen, an input box and a determination button are displayed together with a message such as "INPUT MAXIMUM AMOUNT USED IN GAME. *BENEFIT INFORMATION IS NOTIFIED WHEN AMOUNT REACHES SET AMOUNT.". Thereafter, when an accumulated amount of gaming value such as credit becomes equal to or larger than the use amount in accordance with the progress of the game, the screen is switched to a benefit information screen and benefit information suitable for the attribute of the player is displayed.

The PTS terminal 1700 exchanges data with the slot machine 1010 under common data interface. The PTS terminal 1700 can therefore be embedded in various types of gaming machines made by various manufacturers. For this reason, in the game system 1 having different types of gaming machines including the slot machine 1010, the information provision system A1 can be easily constructed by attaching the PTS terminal 1700 to a gaming machine.

The PTS terminal 1700 includes a panel 1710. Components provided on the front surface of the panel 1710 are viewable by the player. Meanwhile, components provided on the back surface of the panel 1710 are housed inside the slot machine 1010 and are not viewable by the player.

On a right portion of the front surface of the panel 1710, an LCD 1719 having a touch panel function is provided. The LCD 1719 displays, for example, benefit information, membership information, and information suitable for members, and is sized 6.2 inches (about 15.7 centimeters). Around the LCD 1719, an LCD cover 1719*a* is provided. While in this example the LCD 1719 has a touch panel function, instructions from the player may be input through another input device such as a keyboard or a mouse.

In addition to the above, a light emitting panel 1720*a* which is connected to LEDs and emits light is provided above the LCD 1719 and the LCD cover 1719*a*. The light emitting panel 1720*a* is, for example, made of polycarbonate, connected to a plurality of (for example, seven) full-color LEDs 1721*a* arranged on the back side of the panel 1710, and emits light in accordance with light emission from the full-color LEDs 1721*a*.

Below the LCD 1719 and the LCD cover 1719*a*, a light emitting panel 1720*b* connected to LEDs and emits light is similarly provided. The light emitting panel 1720*b* is, for example, made of polycarbonate, connected to a plurality of (for example, seven) full-color LEDs 1721*b* (not illustrated) arranged on the back side of the panel 1710, and emits light in accordance with light emission from the full-color LEDs 1721*b*.

The full-color LEDs 1721*a* (light emitting panel 1720*a*) and the full-color LEDs 1721*b* (light emitting panel 1720*b*) are arranged to be able to perform light emission contributing to obsession prevention.

In addition to the above, a camera window 1712 is disposed to the right of the LCD 1719, and a human detection camera arranged inside the LCD cover 1719*a* or on the back side of the panel 1710 takes a picture of the player, etc. through the camera window 1712. For example, the camera window 1712 may be a half mirror member for which a shielding process is performed, e.g., smoked.

In addition to the above, a home button 1722 is disposed on the LCD cover 1719*a* which is below and to the right of the LCD 1719. The home button 1722 is a button which is used to shift a screen displayed on the LCD 1719 to a predetermined superordinate screen.

In addition to the above, a speaker duct 1706 is disposed on the LCD cover 1719*a* and to the right of the LCD 1719, and a bass-reflex speaker 1707 is disposed on the back side of the panel 1710 to correspond to the speaker duct 1706. Furthermore, a speaker duct 1708 is disposed to the left of the LCD 1719, and a bass-reflex speaker 1709 is disposed on the back side of the panel 1710 to correspond to the speaker duct 1708. These speakers are dedicated speakers for the PTS terminal 1700, and are independent from the speakers of the slot machine 1010 provided for slot machine games. These speakers realize synchronous effects and voice communication, output notification sound when the player forget to remove the IC card 1500, and output sound and voice contributing to obsession prevention. Because sound from the speakers can be heard on the front side (player side) in stereo through the above-described speaker ducts 1706 and 1708, it is possible to provide the speakers on the back side of the panel 1710, and hence space saving of (the panel surface of) the PTS terminal 1700 is consequently achieved.

Below and to the left of the LCD 1719, a microphone opening portion 1714 and an microphone opening portion 1716 are provided in the LCD cover 1719*a*. Inside the LCD 1719, microphones 1715 and 1717 are provided to correspond to the openings.

A card insertion slot 1730 is disposed at a lower left portion of the front surface of the panel 1710 to allow the IC card 1500 to be inserted and ejected. Full color LEDs 1731 (not illustrated) are disposed at a card insertion portion of the card insertion slot 1730. As the LEDs emit light in different colors, it is possible to notify the remaining number of IC cards 1500 accommodated in a card stacker 1742. An eject button 1732 is disposed at the card insertion slot 1730. In order to indicate the position of the eject button 1732 and to show how ejection is performed, a red LED provided in the vicinity of the eject button 1732 is switched on.

On the back side of the panel 1710, a card unit 1741 and the card stacker 1742 are provided to positionally correspond to the card insertion slot 1730. The card insertion slot 1730 is part of the card unit 1741. The card stacker 1742 is able to accommodate more or less 30 IC cards 1500. When a player who newly plays a unit game settles the credit, the IC card 1500 accommodated in the card stacker 1742 is taken out and ejected through the card insertion slot 1730.

In the IC card 1500 taken in through the card insertion slot 1730 and accommodated in the card unit 1741, credit information is updated by using the NFC, etc. when the credit is settled, and then the IC card 1500 is ejected through the card insertion slot 1730. While the player is playing the unit game, the IC card 1500 is fully accommodated inside the card unit 1741.

In the settlement of the credit, if the absence of the player is detected by the human detection camera, etc. even though the IC card 1500 is still in the machine, the IC card 1500 may be retained in the card stacker 1742. With this arrangement, the IC card 1500 is not stored in the card unit 1741 for a long time when, for example, the player intentionally left the machine without collecting the IC card 1500 because the remaining credit was small, or when the player simply forgot to collect the IC card 1500 before leaving the machine. This arrangement is particularly effective when the player notified of the benefit information temporarily moves to another location.

At an upper left part of the front surface of the panel 1710, a USB terminal 1737 and an audio terminal 1738 are provided. To the USB terminal 1737, a USB device is connectable for the purpose of electric charging, etc. The audio terminal 1738 is, for example, a quadrupole-terminal. A headset may be connected to this terminal in order to have a conversation by using a headphone and a microphone. The audio terminal 1738 may be a double-pole or triple-pole terminal, and sound is heard by a headphone connected thereto.

A touch unit 1745 is provided on the front surface of the panel 1710 and to the left of the LCD 1719. The touch unit 1745 includes RFID modules which are able to function as a writer writing data by data communication into an IC device including an IC chip (e.g., a mobile phone or a smartphone having a communication function by using a contactless IC card or NFC) and a reader reading data from the IC device by data communication. LEDs are provided at the four corners of the front surface of the touch unit 1745, respectively. In addition to the touch unit 1745 or in place of the touch unit 1745, an information recording medium reading device may be provided to read information from an information recording medium such as a magnetic card. In this case, the magnetic card is regarded as the member card in place of the IC card 1500.

(Specific Example of Information Provision System: External Appearance of Signage)

Figure 11:
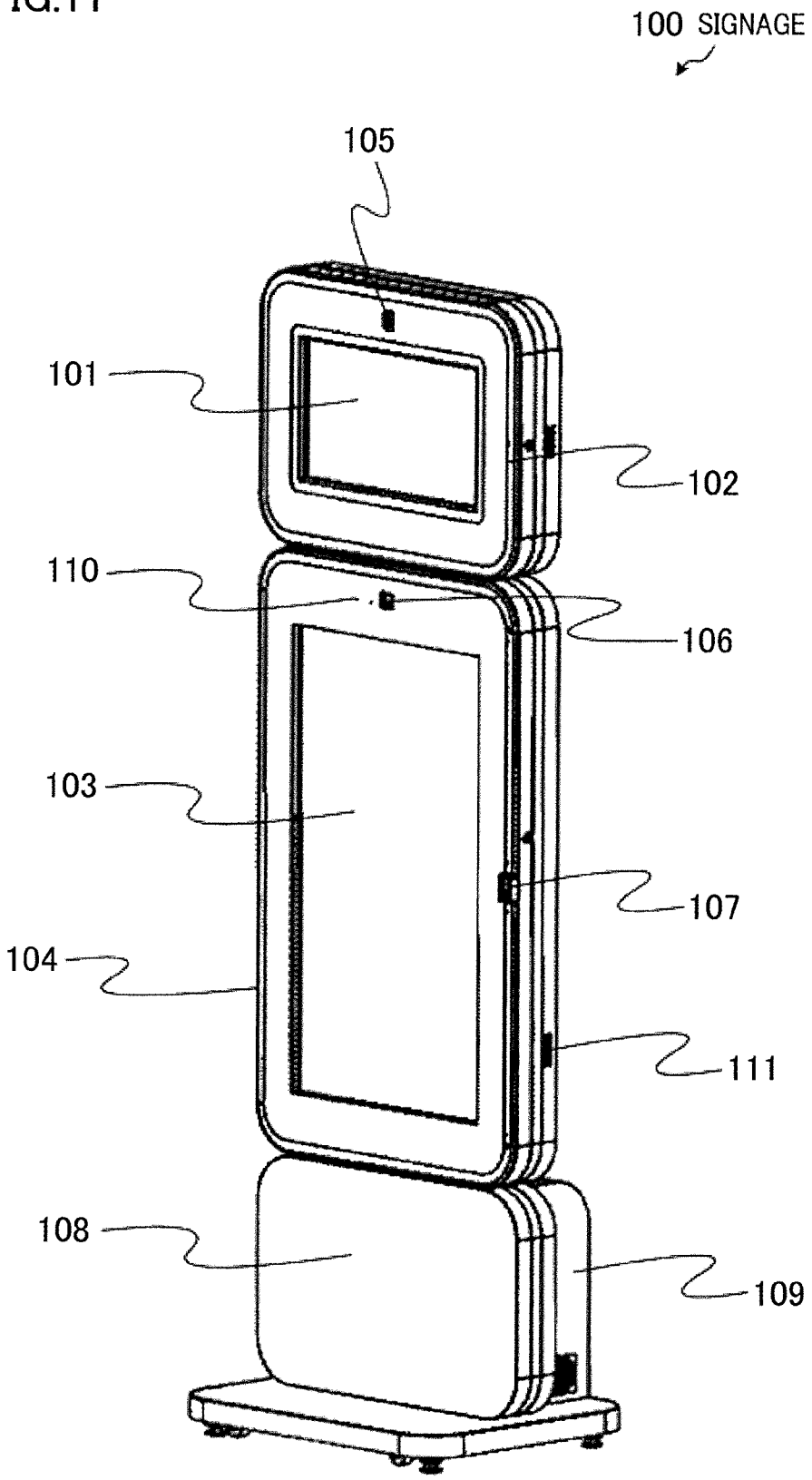
FIG. 11 is a perspective view of a signage.

FIG. 11 shows a signage 100 which can be used in the game system 1 of an embodiment of the present invention. The signage 100 is an information display device which is mainly used to display an advertisement (including a signboard) of a shop, a floor guide of a hall and the like, and is connected to a server (e.g., the bonus server 11 or the member management server 13) of the game system 1 over a network. The signage 100 has functions of the input device A4 and the benefit issuance device A5 shown in FIG. 1.

The signage 100 includes an LCD 101 and an LCD 103 having a touch panel function. The LCD 101 is, for example, a liquid crystal display device sized 24 inches (about 60.96 centimeters). The LCD 103 is, for example, a liquid crystal display device sized 46 inches (about 116.84 centimeters). As described above, these LCDs display an input screen for a use amount, advertisement information, guide information, etc. The touch panel function of the LCD 103 is, for example, an infrared type. While in this example the LCD 103 has the touch panel function, instructions from the player may be input through another input device such as a keyboard or a mouse.

Each of the LCD 101 and the LCD 103 is housed in a cabinet. On the peripheral portions of the front surfaces of the cabinets, effect LEDs 102 and 104 are provided for effects. The effect LEDs 102 and 104 are, for example, LED lights on tapes.

The signage 100 further includes motion sensors 105 and 106 for the cabinet of the LCD 101 and the cabinet of the LCD 103, respectively. The motion sensors 105 and 106 are, for example, cameras, and analyze actions of the user of the signage 100 and actions of customers passing through the passage by videos taken by the motion sensors 105 and 106.

The signage 100 includes a touch unit 107 which functions as the input unit A51 and an RFID module which is capable of performing data communications with a contactless IC card and a mobile phone and a smartphone having a communication capability based on the NFC. A member is allowed to log in by presenting a member card (IC card) associated with the member to the touch unit 107. As a result of this, a menu screen for the member or information regarding the member is displayed on the LCD 101 or the LCD 103. The information of the member is, for example, acquired from the member management server 13. When "use amount" is stored in the member card, obsession prevention tailored for each player is possible as the use amount in the member card is read. In this connection, when the use amount is read from the member card, the use amount is preferably displayed on the LCD 101 or the LCD 103 to allow the player to correct the use amount. When the player leaves the slot machine 1010 for the signage 100 in response to benefit information and presents the member card, plural types of benefits associated with the player indicated by the member card are displayed on the LCD 101 to be selectable.

A stuff member of the hall is also allowed to log in by presenting his/her IC card and cause the LCD 101 or the LCD 103 to display a menu screen, etc. for the stuff member.

In comparison with the PTS terminal 1700, the signage 100 does not have a card unit for retaining IC cards 1500, and only has the touch unit 107. However, in the signage 100, even though a user presents the IC card and then leaves the signage 100 without logging off, information of the member displayed on the LCD 103, etc. in response to the presentation of the card disappears after a predetermined time elapses, and the user is automatically logged off.

In addition to the above, the signage 100 includes a microphone 133 which is provided in the cabinet of the LCD 103 and is configured to collect sound. The cabinet of the LCD 103 has a microphone opening portion 110 which positionally corresponds to the microphone. The microphone opening portion 110 is formed next to the motion sensor 106.

In addition to the above, the signage 100 includes speakers 134 and 135 which are provided in the cabinet of the LCD 103 and are configured to output sound. Speaker ducts are disposed in the cabinet of the LCD 103 to positionally correspond to the speakers.

In addition to the above, the signage 100 includes a base unit 108 supporting the cabinet of the LCD 101 and the cabinet of the LCD 103 and a control unit 109 which accommodates a controlling unit controlling each LCD, LEDs, etc.

(Specific Example of Information Provision System: External Appearance of Service Terminal)

Figure 12:
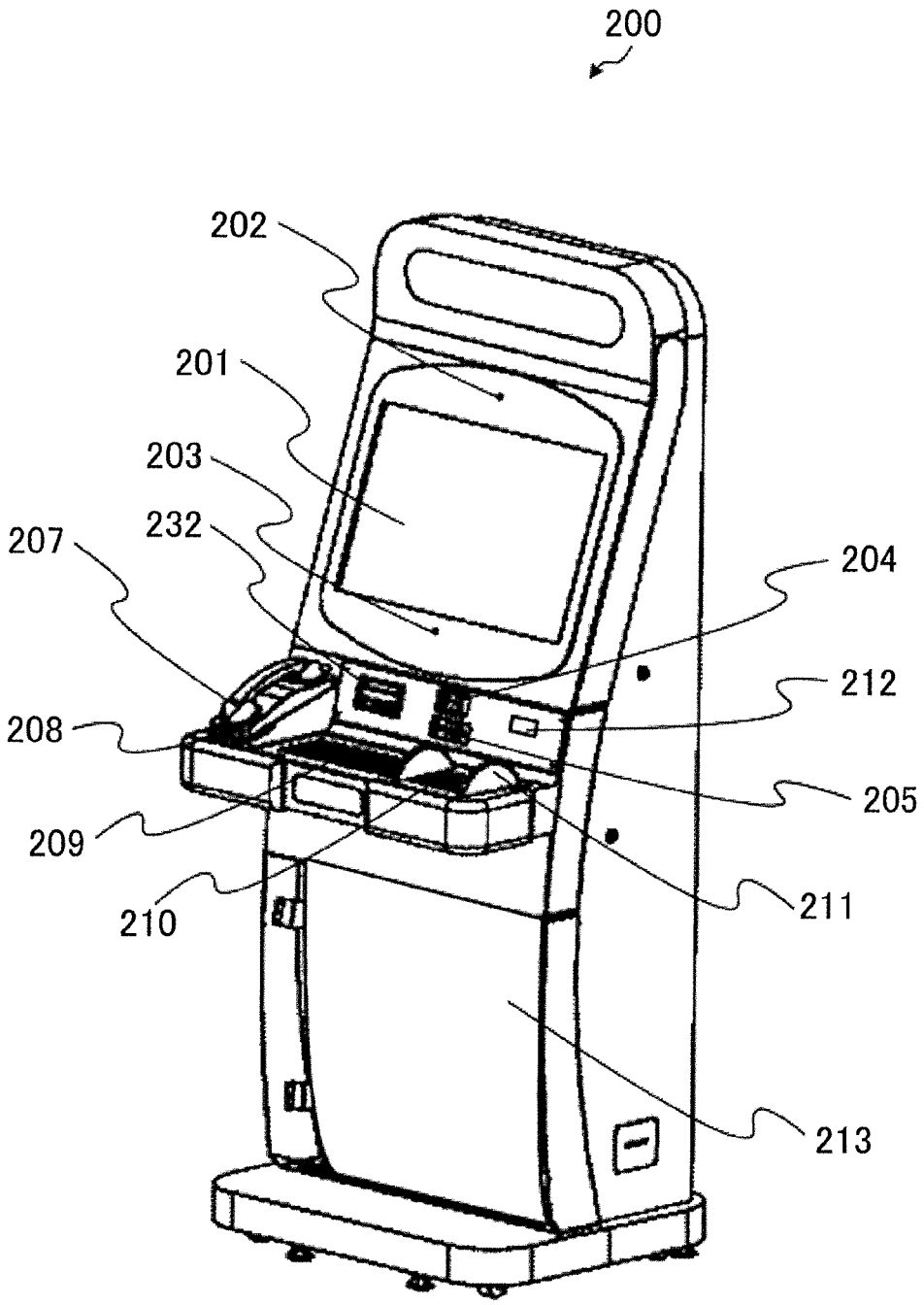
FIG. 12 is a perspective view of a service terminal.

FIG. 12 shows a service terminal 200 which can be used in the game system 1 of an embodiment of the present invention. The service terminal 200 is an information display device mainly used for displaying information regarding games played in the hall, e.g., start of a bonus game executed by the bonus server 11, countdown for the start, a winning ranking of the day, and a ranking of gaming machines. The service terminal 200 can be connected to the servers (e.g., the hall management server, the bonus server 11, and the member management server 13) of the game system 1 over a network. The service terminal 200 has functions of the input device A4 and the benefit issuance device A5 shown in FIG. 1.

The service terminal 200 includes an LCD 201 having a touch panel function. The LCD 201 is, for example, a liquid crystal display device sized 24 inches (about 60.96 centimeters). As described above, an input screen for a use amount, information regarding games played in the hall, etc. are displayed on this LCD. While in this example the LCD 201 has the touch panel function, instructions from the player may be input through another input device such as a keyboard or a mouse.

In addition to the above, the service terminal 200 includes motion sensors 202 and 203 which are provided above and below the LCD 201, respectively. The motion sensors 202 and 203 are, for example, cameras, and analyze actions of the user of the service terminal 200 and actions of customers passing through the passage by videos taken by the motion sensors 202 and 203.

The service terminal 200 includes a touch unit 204 which functions as the input unit A51 and an RFID module which is capable of performing data communications with a contactless IC card and a mobile phone and a smartphone having a communication capability based on the NFC. A member is allowed to log in by presenting a member card (IC card) associated with the member to the touch unit 204. As a result of this, a menu screen for the member or information regarding the member is displayed on the LCD 201. The information of the member is, for example, acquired from the member management server 13. In addition to the touch unit 204 or in place of the touch unit 204, an information recording medium reading device may be provided to read information from an information recording medium such as a magnetic card. In this case, the magnetic card is regarded as the member card in place of the IC card 1500.

When "use amount" is stored in the member card, obsession prevention tailored for each player is possible as the use amount in the member card is read. In this connection, when the use amount is read from the member card, the use amount is preferably displayed on the LCD 204 to allow the player to correct the use amount. When the player leaves the slot machine 1010 for the service terminal 200 in response to benefit information and presents the member card, plural types of benefits associated with the player indicated by the member card are displayed on the LCD 204 to be selectable.

A stuff member of the hall is also allowed to log in by presenting his/her IC card and cause the LCD 201 to display a menu screen, etc. for the stuff member.

A card insertion slot 205 is provided in the service terminal 200 to allow the IC card 1500 to be inserted and ejected. The card insertion slot 205 is provided with an eject button. A card unit is provided inside the housing of the service terminal to correspond to the card insertion slot 205. The card insertion slot 205 is part of the card unit.

When the member card is inserted into the card insertion slot 205, a menu screen for the member and information regarding the member may be displayed on the LCD 201. The card unit is able to issue and collect limited cards and reward wards.

The service terminal 200 is provided with a ticket printer 232. The ticket printer 232 is able to issue and collect tickets and coupons, and may be configured to have a function of the bill validator.

In addition to the above, the service terminal 200 includes a handset 207 which is used for conversations based on VoIP. The user of the service terminal 200 is allowed to have conversations with a user of another service terminal 200 and a player at a gaming machine by using the handset 207. An incoming call LED 208 is controlled to emit light when there is an incoming call based on VoIP.

The service terminal 200 further includes a keyboard 209 and a ten keypad 210 by which the user inputs data (e.g., setting of a use amount, membership registration, and text chat). On the both sides of the ten keypad 210, LED plates 211 are provided for peep prevention.

The service terminal 200 further includes a QR code scanner 212 for reading QR codes (registered trademark) on emails sent to mobile phones, etc. In addition to the above, the service terminal 200 includes a storage unit 213 which accommodates a control unit controlling the LCD and LEDs.

(Information Provision Service: Service Example 1)

Figure 13:
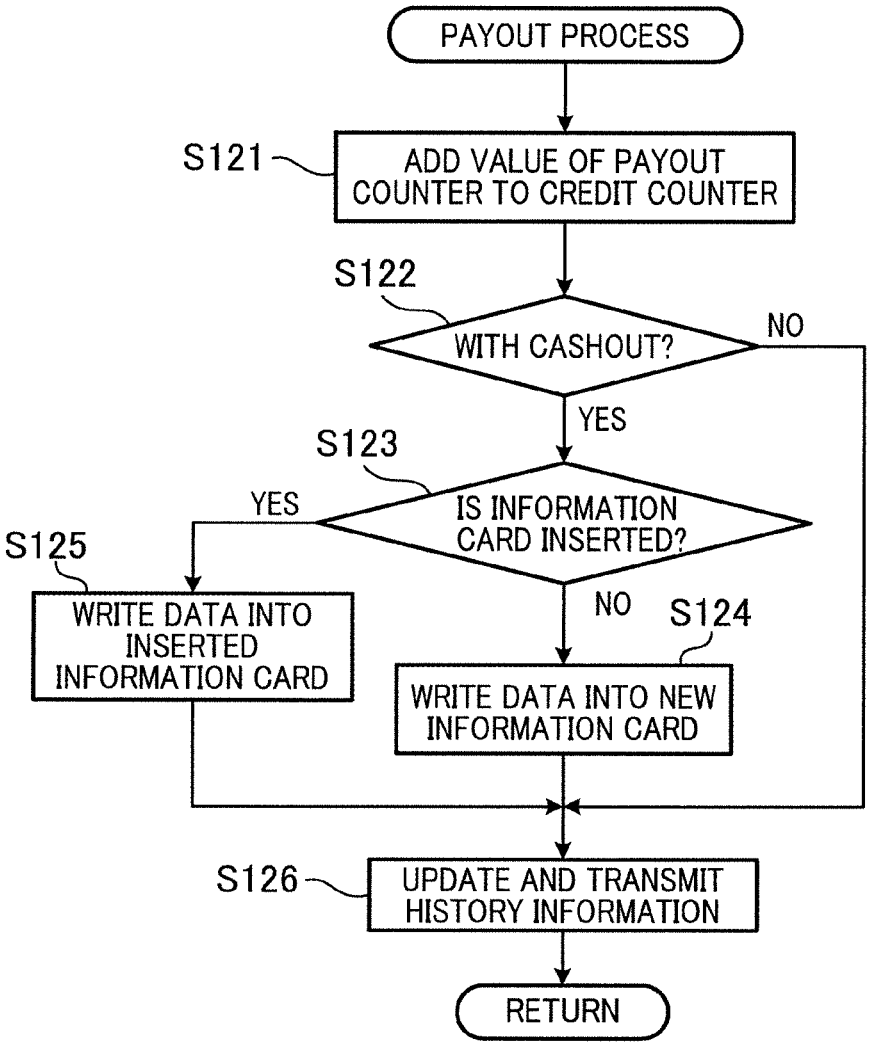
FIG. 13 is a flowchart of a payout process.

FIG. 13 shows an example of a sequence of information provision service. A main flow of the information provision service will be described with reference to this sequence. The service example 1 deals with a case where the information manager A4 has a function of the information provision device A3 and whether to take an action for a player is determined based on game history.

When a game result is obtained by playing a game at the slot machine 1010 shown in FIG. 8, a payout process shown in FIG. 13 is executed. In the payout process, a value of a payout counter is added to a credit counter by a process executed by an unillustrated main CPU (S121), and whether a CASHOUT button has been pressed is determined (S122).

When the CASHOUT button has been pressed by the player, the main CPU acquiring a positive result in the step S122 shifts from the step S122 to the step S123 and determines whether an IC card 1500 (membership information card or non-membership information card) was inserted into the card unit 1741 through the card insertion slot 1730 and the game was played.

Acquiring a positive result in the step S123 indicates that the IC card 1500 (membership information card or non-membership information card) owned by the player has been inserted into the card unit 1741. The main CPU therefore shifts from the step S123 to the step S125 and writes the value of the credit counter into the IC card 1500 (membership information card or non-membership information card) having been inserted into the card unit 1741.

Meanwhile, acquiring a negative result in the step S123 indicates that the game was played while no IC card 1500 (membership information card or non-membership information card) was inserted into the card unit 1741. In this case, the main CPU shifts from the step S123 to the step S124 and writes, as remaining amount information, the value of the credit counter (i.e., a remaining amount of credit as a result of the game) into an unused IC card 1500 which is prepared in the card stacker 1742 in advance.

After the step S124 or when the result of the above-described step S122 is negative (i.e., the CASHOUT button is not pressed), the main CPU shifts to the step S126, and updates the history information after single execution of the game and sends the updated history information to an information manager 500.

In this way, as the main CPU executes the payout process, the IC card 1500 (membership information card or non-membership information card) to which the remaining amount information has been written is ejected from the card insertion slot 1730. The player may bring the ejected IC card 1500 to a predetermined casher to convert the remaining amount information written in the IC card 1500 to cash. When the player continues the game, the player inserts the IC card 1500 into the card insertion slot 1730 of another slot machine and plays a game at the slot machine with the remaining amount information written in the IC card 1500. The remaining amount information written in the IC card 1500 is information indicating a gaming value, such as a result of conversion of a remaining credit amount after the game at the slot machine 1010 into cash or a credit amount. Such information is read by a reader of the casher 202 (FIG. 7) and money corresponding to the information is paid out to the player.

The history information sent to the information manager 500 in the step S126 includes the following sets of information as shown in FIG. 14A: slot machine identification information for identifying a slot machine which has generated the history information; date and time of each game; an inserted amount if money was inserted at the start of the game; a game result (e.g., type of winning); an inserted monetary amount (which is an amount read from an IC card 1500 when the IC card 1500 was inserted, is an amount identified by the bill validator 1022 (FIG. 8) when money was inserted, or is a total amount when both the IC card 1500 and money were inserted); a remaining amount (including both a remaining amount of a payout counter as a result of the game and a remaining amount of the credit counter); a payout amount (an amount rewritten into the IC card 1500 (membership information card or non-membership information card) from the credit counter and paid out); and information card identification information (e.g., information unique to each card such as a number "001") by which the IC card 1500 (membership information card or non-membership information card) to which these sets of history information are stored is specified. When the associated IC card 1500 has already been inserted into the slot machine 1010 before the game play, the IC card 1500 is a member card or a non-member card owned by the player in advance. Therefore "SUCCESSIVE USE 1" is associated with the information card identification information of the history information (e.g. FIG. 14B) and the history information is transmitted. Meanwhile, when no IC card 1500 is inserted before the game play, information "SUCCESSIVE USE 0" indicating that the history information is associated with a non-membership information card newly ejected from the card stacker 1742 is associated with the information card identification information of the history information and the history information is transmitted.

With this arrangement, in the information manager 500, when receiving this history information from the slot machine 1010 and information regarding the successive use associated with the information card identification information is "SUCCESSIVE USE 0" in the received history information, it is indicated that the history information is associated with a non-membership information card which has been newly ejected, i.e., a new player (usually a non-member) starts to use the IC card 1500. This set of history information is placed at the top of the list, and each time a set of history information in which the same information card identification information is associated with "SUCCESSIVE USE 1" is received, the set of history information is accumulatively stored in the same list (FIG. 15). In summary, a non-membership information card is newly ejected from the slot machine 1010 where a non-member player plays a game for the first time, and each time the player inserts this IC card into another slot machine 1010 and plays a game with the remaining amount in the non-membership information card, the player actions are accumulatively stored in the database of the information processor 500 as a series of history information.

FIG. 14A shows history information sent from a slot machine 1010A to the information manager 500 when a player inserts money into a slot machine (slot machine 1010A) having slot machine identification information "0010" and plays a game, and then the player presses the CASHOUT button and an IC card 1500 having the information card identification information "0001" is issued by the card stacker 1742 as a non-membership information card.

FIG. 14B shows history information sent from a slot machine 1010B (PTS terminal 1700) to the information manager 500 when a player inserts a non-membership information card (IC card 1500) with information card identification information "0001" into the card insertion slot 1730 of a slot machine (slot machine 1010B) with slot machine identification information "0011" and plays a game with the remaining amount on the IC card 1500, and then the player presses the CASHOUT button and the non-membership information card (IC card 1500) in which the remaining amount has been updated is ejected from the card insertion slot 1730. When such a single non-membership information card is inserted into different slot machines 1010 one by one and continuously used, sets of the history information sent from the respective slot machines 1010 to the information manager 500 are stored and managed by a storage unit such as a database 560, a RAM 553, etc. of the information manager 500, as a series of history information associated with the information card identification information, as shown in FIG. 15.

In other words, because a single non-membership information card is continuously used, the player actions (information such as at which slot machines games are played, how much money is used, game results, and payout amounts) of a non-member player can be grasped by the information manager 500, as if the non-member player is a member.

The main CPU sends such history information to the information manager 500 in association with information for specifying a slot machine 1010 (e.g., a number unique to each slot machine such as "0010").

The information manager 500 is therefore able to accumulatively store the game history at each slot machine 1010 for each IC card 1500 (membership information card or non-membership information card). When an IC card 1500 is successively used at different slot machines 1010, the identification information of each slot machine 1010 and history information associated with that identification information are accumulatively stored for each IC card 1500 (FIG. 15). It is therefore possible to grasp player actions (information of how many times games are played, at which slot machines 1010 in the gaming hall games are played, and how much money is used) of the player who owns the IC card 1500.

In the history information shown in FIG. 14A, 50 dollars were inserted at 10:00 of Aug. 1, 2018 and the remaining amount at a slot machine 1010A specified by slot machine identification information "0010" became 50 dollars, then the remaining amount was increased to 80 dollars at 10:05 as a prize was awarded in a game, the remaining amount was decreased to 20 dollars at 10:10 as a result of playing the game, 30 dollars were additionally inserted at 10:15 and added to the remaining amount at the slot machine 1010A, and consequently the remaining amount became 50 dollars. Then the remaining amount became 60 dollars at 11:00 as a result of the game, the CASHOUT button was pressed at 11:05, and all remaining amount was written into the IC card 1500 and paid out.

The history information shown in FIG. 14A is information sent from the slot machine 1010 (PTS terminal 1700) to the information manager 500 as history information in which a history from the ejection of an IC card 1500 from the slot machine 1010A to the ejection of, as a new non-membership information card, a new IC card 1500 which is prepared in the card stacker 1742 in advance, as history information associated with the new non-membership information card (information card identification information).

The history information shown in FIG. 14B indicates that the IC card 1500 (with the information card identification information "0001") was inserted into another slot machine 1010B (PTS terminal 1700) with the slot machine identification information "0011" at 11:30 of Aug. 1, 2018, the remaining amount (60 dollars) was read from the IC card 1500 to the slot machine 1010B, and then a game was run and the CASHOUT button was pressed and the remaining amount (10 dollars) at the slot machine 1010B was written into the IC card 1500 and paid out at 12:00. This history information shown in FIG. 14B is sent from the slot machine 1010B to the information manager 500 when the CASHOUT button is pressed.

When an IC card 1500 is inserted into the slot machine 1010B, the slot machine 1010B (PTS terminal 1700) sends the information card identification information read out from the inserted IC card 1500 to the information manager 500. The information manager 500 determines whether the received information card identification information is matched with identification information of membership information cards registered in the database 560. When there is no matched identification information, the information manager 500 notifies the slot machine 1010B that the card is a non-membership information card. When the inserted card is a membership information card, the slot machine 1010B is notified of this result. When the inserted IC card 1500 is a non-membership information card, based on the notified information, the slot machine 1010B stores the history information so that information indicating "SERIAL USE 1" shown in FIG. 14B is associated with the information card identification information. In this way, the slot machine 1010B executes a process in a case where the inserted IC card 1500 is a non-membership information card.

(Information Management by Information Management System)

Figure 16:
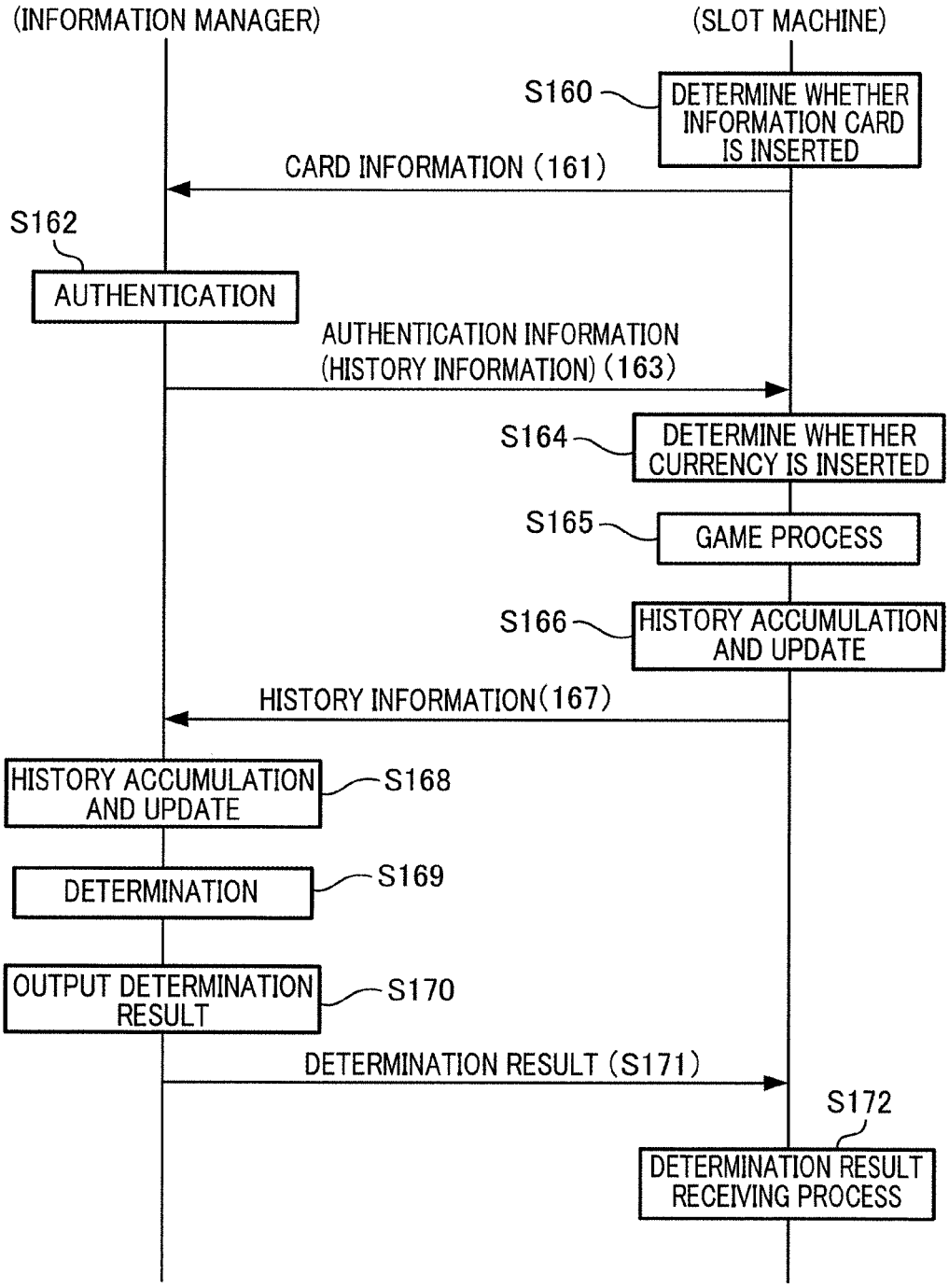
FIG. 16 is a flowchart of an example of a sequence of information provision service.

FIG. 16 is a flowchart of a process of sending and receiving history information between the information manager 500 of the information management system 100 and each slot machine 1010 and a determination process based on the history information.

To begin with, when it is determined in a slot machine 1010 that an IC card 1500 (membership information card or non-membership information card) has been inserted (S160), the slot machine 1010 reads card information (information card identification information such as a card number) from the inserted IC card 1500 and sends the card information to the information manager 500. If the slot machine 1010 takes a picture of the face of the player by the human detection camera at this stage, the slot machine 1010 sends the image data to the information manager 500 together with the card information. In addition to or in place of a face picture, various types of human body information such as a fingerprint may be sent.

The information manager 500 executes an authentication process based on the card information and the image data sent from the slot machine 1010 (S162). To be more specific, whether the card is a card owned by a member (membership information card) or a card owned by a non-member (non-membership information card) is determined based on the information card identification information (information card number), and authentication based on the registration information in the membership information card, i.e., image authentication if a face image has been registered is performed to determine whether the card holder is a genuine member.

As a result of the authentication process above, the card holder is identified as a genuine registered member. When the card holder is not a registered member but the information card number is matched with a card number of a genuine card (i.e., an IC card 1500 prepared in the card stacker 1742 of each slot machine 1010), it is determined that the card is a genuine non-membership information card.

After the completion of the authentication process, the authentication result is sent to the slot machine (one of the slot machines 1010) which is the sender of the card information, as authentication information (S163).

The slot machine 1010 having received this authentication information allows the player to play the game based on the determination that the inserted IC card 1500 is a genuine card.

When a gaming value (e.g., money) is inserted (S164), the validity of the inserted money is checked and the value of the money is read, and these sets of information are stored in the RAM of the slot machine 1010. When money is inserted while the IC card 1500 (membership information card or non-membership information card) has been inserted, a credit amount corresponding to the inserted money is added to a credit amount read from the IC card 1500, for playing the game. When no IC card 1500 has been inserted, a credit amount corresponding to the inserted money is used to play the game. When an IC card 1500 has been inserted, only part of the credit amount stored in the IC card 1500 may be used for each game play. The credit amount to be used in each game play can be set at will by the player by means of the touch panel on the LCD 1719 of the PTS terminal 1700.

A game process is executed with a credit amount which is stored in the inserted IC card 1500 or corresponds to inserted money (S165). Results of this game process (e.g., a type of winning and a payout amount) are serially stored in the RAM of the slot machine (one of the slot machines 1010) as history information in association with the information card identification information (information card number).

When the game is finished and, for example, the player presses the CASHOUT button, the history information stored in the slot machine is sent to the information manager 500 (S167). This step is a step S126 of the payout process shown in FIG. 13. In cases where the game starts at each slot machine 1010 while no IC card 1500 (membership information card or non-membership information card) has been inserted, a history from this game to the ejection of a new IC card 1500 in response to the pressing of the CASHOUT button is sent to the information manager 500, as history information. Because this history information is a history of the game played without the insertion of the IC card 1500, the history information is associated with the information card identification information (information card number) of the IC card 1500 which is newly issued as a non-membership information card. Meanwhile, in cases where the game starts while the IC card 1500 (membership information card or non-membership information card) has been inserted, history information from the insertion of the IC card 1500 to the ejection thereof is associated with the information card identification information of the IC card 1500 and sent from the slot machine 1010 to the information manager 500.

When the information manager 500 receives the history information which is associated with the IC card 1500 and sent from the slot machine 1010, if this history information corresponds to the information card identification information (information card number) associated with the history information stored in the database, the information manager 500 stores the received history information in the database in association with the existing history information (S168). This association of the sets of history information is done to indicate that the sets of history information are used by the same player. A set of history information in which information indicating "SUCCESSIVE USE" associated with the information card identification information (information card number) of the non-membership information card is "0" is placed at the top of the list, and sets of history information in which information indicating "SUCCESSIVE USE" is "1" are listed in a chronological order as a series of history in the database (see FIG. 15). In other words, as long as the IC card 1500 is continuously used by the same player, even if the player plays games at different slot machines 1010, sets of history information of these games are associated with one another as a series of history information corresponding to the information card identification information (information card number) of the IC card 1500, in the database of the information manager 500. When image data of a face image is also associated with the information card identification information, a set of history information is associated with a series of history information only when face authentication based on the image data is succeeded.

Irrespective of the information of "SUCCESSIVE USE" (0 or 1), a set of history information corresponding to the membership information card is associated with a series of history information corresponding to the same information card identification information (i.e., information card identification information registered for the member player). Also for the history information of a member, whether the member is a genuine member is authenticated by a face image if a face image is registered as membership information and the image data of the face image is sent from the slot machine 1010 in association with the history information.

When the history information associated with the IC card 1500 (membership information card or non-membership information card) is stored in the information manager 500 in this way, the information manager 500 performs, for example, determination based on player actions such as player's obsession to the game, with reference to the history information (S169). This determination process will be described later.

When, for example, addiction is identified as a result of this determination, the information manager 500 performs warding display (S170), and instruction information including the determination result is sent from the information manager 500 to the slot machine 1010 in which the IC card 1500 for which the warning is made is inserted (S171). Because the predetermined warning display is performed by the information manager 500, a manager of the gaming hall is able to take a countermeasure in accordance with the warning. For example, the player who is addicted to the game receives information which indicates that benefit information has been displayed on the slot machine 1010. The slot machine 1010 having received the instruction information outputs the benefit information. With this arrangement, in the information provision system, in response to the benefit information, the player leaves the slot machine 1010 and stops the game play at the slot machine 1010. For this reason, player's obsession to the game is avoided while quelling players' antipathy and avoiding troubles. In this way, a countermeasure for player's addiction or quasi-addiction to the game is realized.

(Determination Process)

Figure 17:
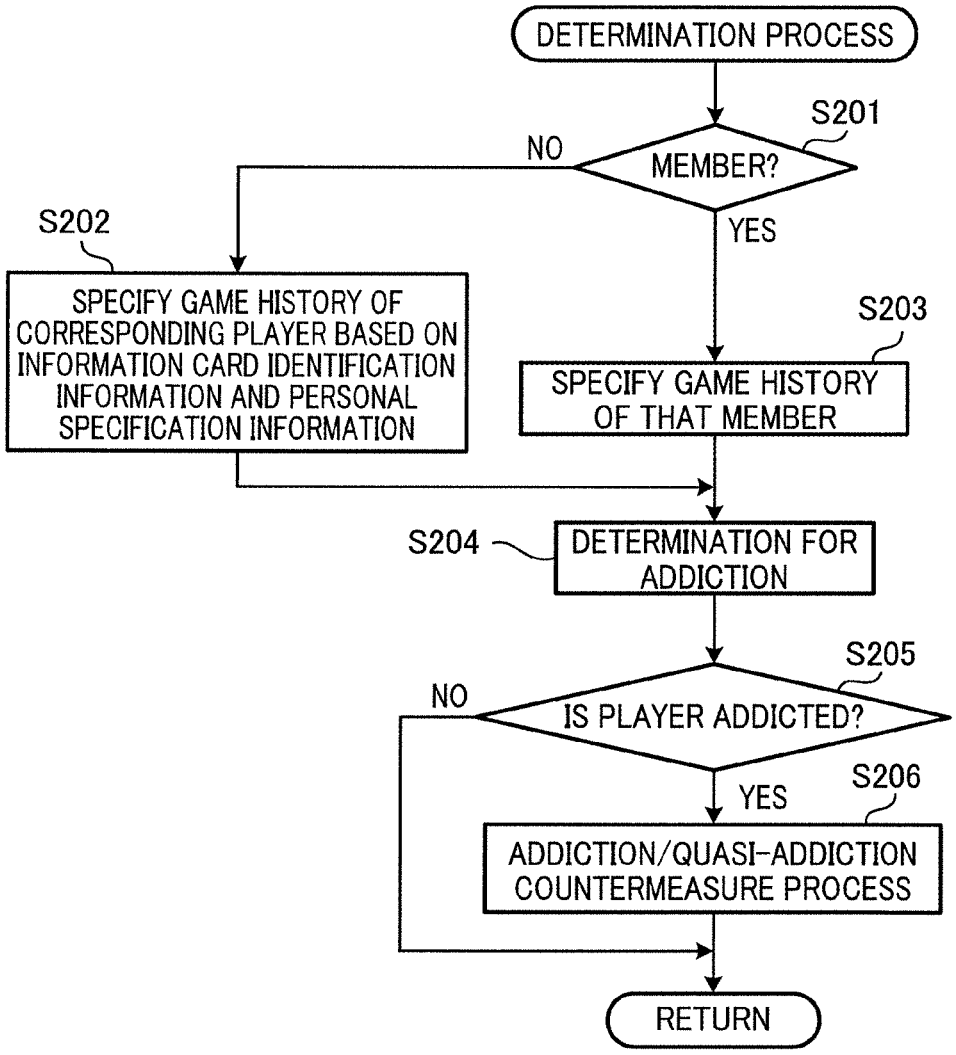
FIG. 17 is a flowchart of a determination process.

FIG. 17 is a flowchart showing details of the determination process in the information manager 500 (S169 in FIG. 16). The information manager 500 executes this determination process each time history information is sent from the slot machine 1010 and stored in the database. The disclosure, however, is not limited to this arrangement, and the determination process may be executed at any timing.

In the determination process, to begin with, the CPU of the information manager 500 determines whether the determination target is a member (S201). To be more specific, whether the history information is that of a member is determined by checking information card identification information (information card number) of member players stored in the database 560.

When the history information which is the target of determination is not information of a member, the CPU acquires a negative result in the step S201, and shifts from the step S201 to the step S202. The CPU then searches the database for the non-member with reference to the information card identification information and the personal specification information (e.g., image data of a face image), and identifies addition to the game of the non-member based on the specified history information (S204).

Meanwhile, when the determination target is a member, the CPU acquires a positive result in the step S201, and shifts from the step S201 to the step S203. The CPU searches the database 560 for history information which is game history of the member. To be more specific, history information is specified based on the registered information card identification information (information card number).

In the step S204, the CPU determines whether the target is addicted to the game with reference to the history information. For example, the following cases are considered as addiction to the game: gaming values are inserted plural times (credits are purchased plural times) in one visit; there is a tendency that the total monetary amount inserted increases over different visits; in one visit, a player continues to play a game until he/she loses (runs out of inserted money) even after he/she achieves a big win in the game; and when the maximum amount is set in advance, a player inserts a gaming value exceeding the maximum amount.

After this determination by the CPU, if addiction is identified, a positive result is obtained in the step S205, and the CPU shifts from the step S205 to the step S206 and executes an addition/quasi-addition countermeasure process. To be more specific, predetermined warning display (e.g., visual display or sound) is performed by the information manager 500 and instruction information is sent to the slot machine (one of the slot machines 1010) in which the IC card 1500 which is the target of determination is inserted, and the determination process is terminated. The slot machine (one of the slot machines 1010) having received the instruction information notifies the benefit information to the player by sound or image. Meanwhile, when a negative result is obtained in the step S205, the player is not addicted and hence the CPU ends the determination process.

(Information Provision Service: Service Example 2)

Figure 18:
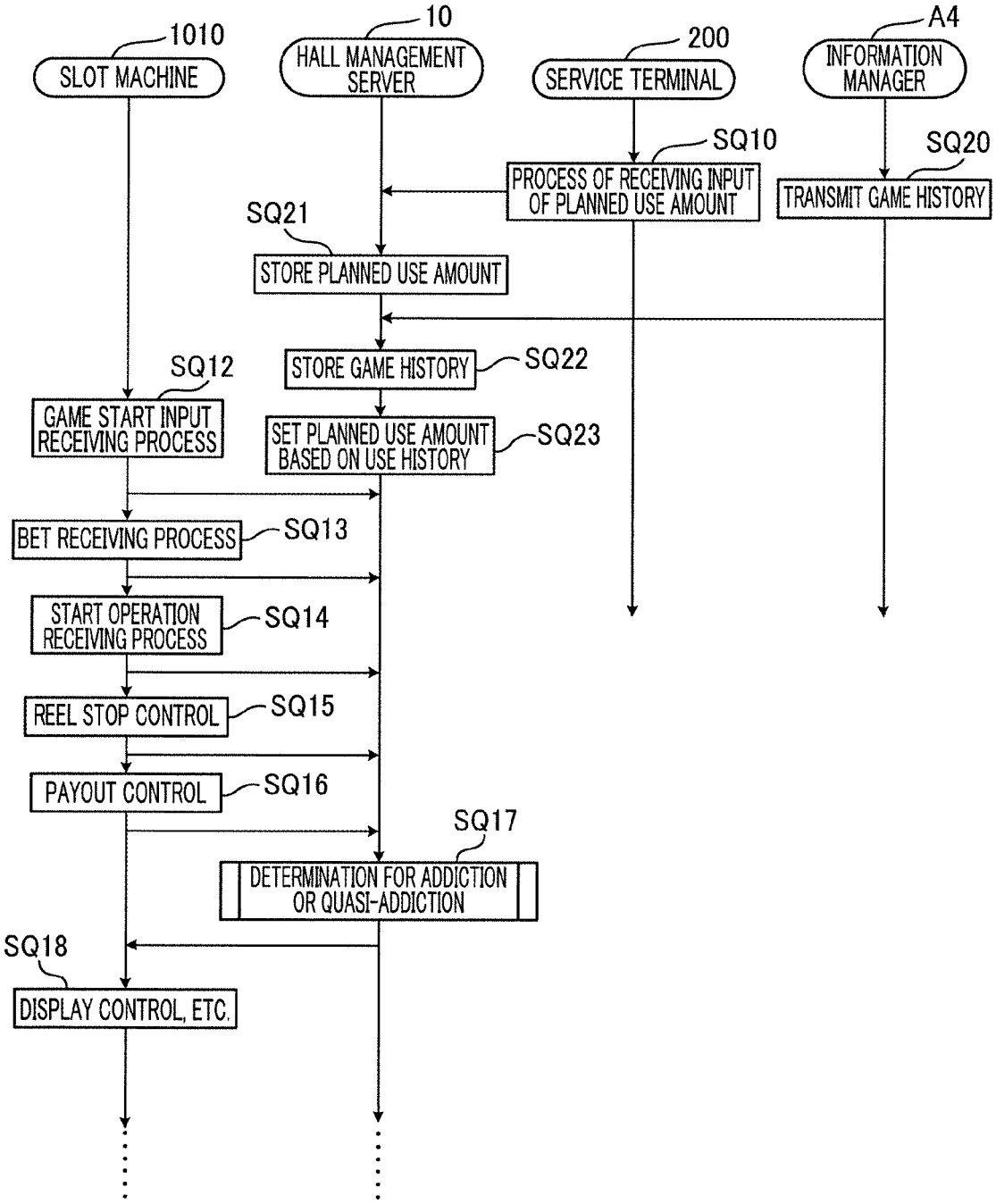
FIG. 18 is a flowchart of an example of a sequence of information provision service.

FIG. 18 shows another example of a sequence of information provision service. A main flow of the information provision service will be described with reference to this sequence. The service example 2 deals with a case where the hall management server 10 has a function of the information provision device A3 and whether to take an action for a player is determined based on accumulated gaming values and a use amount.

In SQ10, the service terminal 200 executes a process of receiving an input of a use amount. For example, the service terminal 200 displays a message demanding the player to input a use amount ("Please input a monetary amount used in the game" "Please input your budget" "Please input prepared money (monetary amount prepared for playing games)" "Please input a use amount of money", etc.) on the LCD 201 and receives an input of a monetary amount (use amount). When a use amount is input by the player, the service terminal 200 sends information (e.g., the use amount and the date and time of input) regarding the use amount to the hall management server 10.

A use amount may not be input at the service terminal 200. For example, a use amount may be input at a slot machine 1010. Alternatively, a use amount may be input at another terminal having an input device, such as the signage 100. For example, the slot machine 1010 may display a message demanding the player to input a use amount ("Please input a monetary amount used in the game" "Please input your budget" "Please input prepared money (monetary amount prepared for playing games)" "Please input a use amount", etc.) on the LCD 1719 of the PTS terminal 1700, receive an input of a monetary amount (use amount), and send information (e.g., the use amount and the date and time of input) regarding the use amount to the hall management server 10.

In SQ21, when the hall management server 10 receives the use amount, the hall management server 10 stores date and time of input of the use amount in a predetermined storage area of an external storage device 1404, together with the use amount. This date and time is a date and time when the input of the use amount is received, but is not limited to this. For example, the date and time may be a date and time when information regarding the use amount is sent by the service terminal 200, or may be a date and time when the hall management server 10 receives the information regarding the use amount.

In SQ20, the information manager A4 sends history information of game history to the hall management server 10. When receiving the history information, the hall management server 10 stores the game history (SQ22) and then sets a use amount based on the game history (SQ23). For example, when the game history indicates a tendency of addiction to the game, the use amount is decreased at a decreasing rate corresponding to the degree of addiction to the game. In other words, the use amount is significantly decreased when the degree of addiction to the game is high, whereas the use amount is slightly decreased when the degree of addiction to the game is low. The use amount is unchanged when there of no tendency of addiction to the game.

In SQ12, the slot machine 1010 executes a game start input receiving process. To be more specific, when receiving an input indicating the start of a session, e.g., insertion of an IC card 1500 into the PTS terminal 1700, the slot machine 1010 sends a session start notification (an example of game information) to the hall management server 10. When receiving the session start notification, the hall management server 10 updates a session start date and time, etc. in a session history table. This session start date and time is a date and time when the input indicating the start of the session is received, but is not limited to this. For example, the date and time may be a date and time when the session start notification is sent by the slot machine 1010, or may be a date and time when the hall management server 10 receives the session start notification.

In SQ13, the slot machine 1010 executes a bet receiving process. For example, in response to betting, the slot machine 1010 sends bet information (an example of game information) including a bet amount to the hall management server 10. When receiving the bet information, the hall management server 10 updates a bet amount, a use amount, etc. in a game history table.

In SQ14, the slot machine 1010 executes a start operation receiving process. For example, in accordance with a start operation (pressing of a spin button), the slot machine 1010 sends a game start notification to the hall management server 10. When receiving the game start notification, the hall management server 10 updates a game start date and time, a game interval, etc. in a game history table. This game start date and time is a date and time when the start operation is received, but is not limited to this. For example, the date and time may be a date and time when the game start notification is sent by the slot machine 1010, or may be a date and time when the hall management server 10 receives the game start notification.

In SQ15, the slot machine 1010 executes reel stop control. The slot machine 1010 sends information regarding stop-displayed symbols (e.g., bonus information) to the hall management server 10. The bonus information (an example of the game information) includes, for example, bonus identification information by which whether a bonus game starts is identifiable and the number of times of execution of the bonus game. Based on the bonus information, the hall management server 10 is able to determine whether the bonus game is being run, i.e., able to identify the start and end of the bonus game. The hall management server 10 counts the number of times of execution of a game after the end of the bonus game.

The bonus information may not be sent from the slot machine 1010 to the hall management server 10 in the reel stop control, and may be sent at any timing. For example, the number of times of execution of the bonus game may be randomly determined at the start of the bonus game (e.g., at the start operation of the bonus game), and sent to the hall management server 10.

In SQ16, the slot machine 1010 executes payout control. For example, the slot machine 1010 sends a payout amount determined in the payout amount determination process to the hall management server 10, together with a game end notification. When receiving the payout amount and the game end notification (examples of the game information), the hall management server 10 updates a payout amount, benefit/loss, game end date and time, etc. in a game history table. The game end date and time is a date and time when the symbols are stop-displayed, but is not limited to this. For example, the date and time may be a date and time when the payout amount is determined, may be a date and time when the slot machine 1010 sends the game end notification, or may be a date and time when the hall management server 10 receives the game end notification.

In SQ17, the hall management server 10 having received the game end notification executes addiction/quasi-addiction determination. As detailed later, in the addiction/quasi-addiction determination, whether an amount (accumulative amount) has reached a use amount after the use amount is set is determined. When it is determined that the accumulative amount has reached the use amount based on a notification flag, the hall management server 10 sends instruction information used for notification of information regarding obsession prevention to the slot machine 1010, and turns the notification flag off.

The instruction information includes notification start information indicating that a notification starts. The notification (e.g., screen information, illumination pattern information, and sound information) may be sent from the hall management server 10, or may be stored in the PTS terminal 1700 in advance.

In SQ18, when receiving the instruction information, the slot machine 1010 performs display control, etc. For example, after displaying a screen notifying that the amount (accumulative amount) used by the player has reached the amount (use amount) set by the player on the LCD 1719 of the PTS terminal 1700, the slot machine 1010 displays the benefit information which indicates that the player is able to acquire a specific advantage at a location different from the slot machine 1010. Furthermore, for example, the full-color LEDs 1721*a* and 1721*b* emit light to indicate that the accumulative amount has reached the use amount (e.g., blink in blue). Furthermore, for example, sound indicating that the accumulative amount has reached the use amount (e.g., a voice message "You reach the set amount. You can receive a benefit at the service terminal 200.") is output from the speakers 1707 and 1709.

According to the arrangement above, because information which prompts the player not to play the game is notified based on the setting done by the player oneself, the player stops playing the game in response to the notification, and hence obsession to the game is avoided.

(Addiction/Quasi-Addiction Determination)

Figure 19:
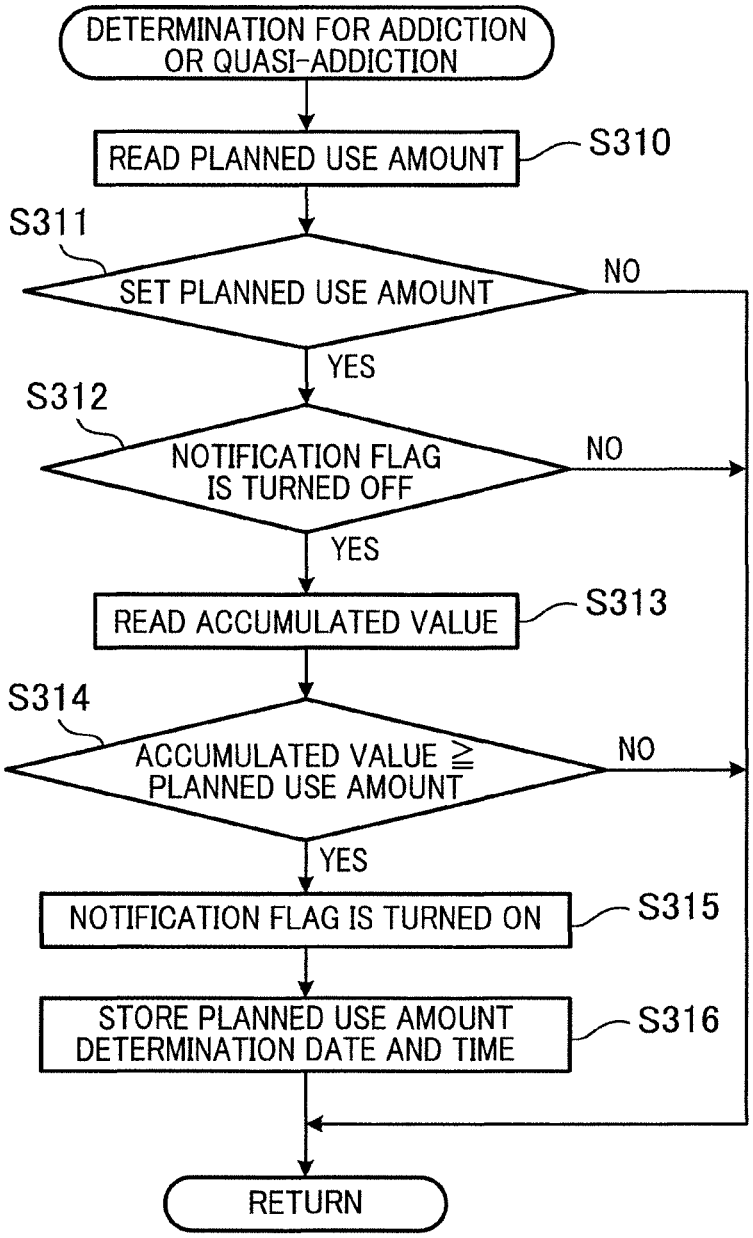
FIG. 19 is a flowchart of addiction/quasi-addiction determination.

FIG. 19 shows an example of a flowchart regarding the addiction/quasi-addiction determination.

In S310, the CPU of the hall management server 10 reads a use amount from a predetermined storage area of the external storage device 1404. After this step, the CPU proceeds to S311.

In S311, the CPU determines whether a use amount has been stored (set). When the use amount has been set, the CPU proceeds to S312. When the use amount has not been set, the CPU ends the use amount determination.

In S312, the CPU determines whether the notification flag is turned off. When the notification flag is turned off, the CPU proceeds to S313. When the notification flag is not turned off, the CPU ends the use amount determination. The notification flag is a flag for determining whether to perform notification of information contributing to obsession prevention.

In S313, the CPU reads an accumulative amount from a predetermined storage area of the external storage device 1404. To be more specific, the CPU adds up benefit/loss after the use amount is set (after the use amount input date and time), in order to calculate the accumulative amount. After this step, the CPU goes back to S314.

In S314, the CPU determines whether the accumulative amount has reached the use amount. When the accumulative amount has reached the use amount, the CPU proceeds to S315. When the accumulative amount has not reached the use amount, the CPU ends the use amount determination.

In S315, the CPU turns the notification flag on. After this step, the CPU proceeds to S316.

In S316, the CPU stores the use amount determination date and time in a predetermined storage area of the external storage device 1404, and ends the use amount determination.

(Information Provision Service: Service Example 3)

Figure 20:
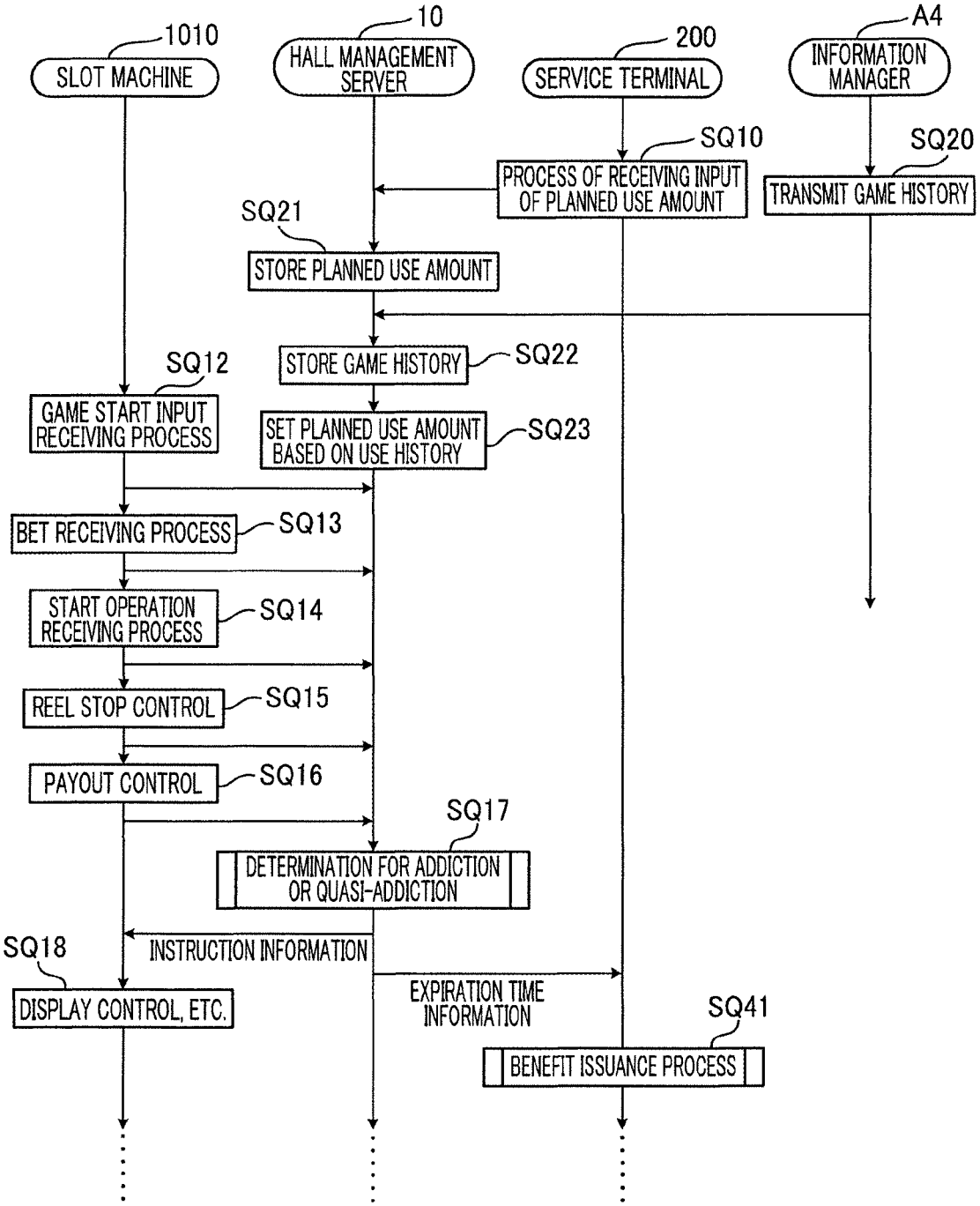
FIG. 20 is a flowchart of an example of a sequence of information provision service.
Figure 21:
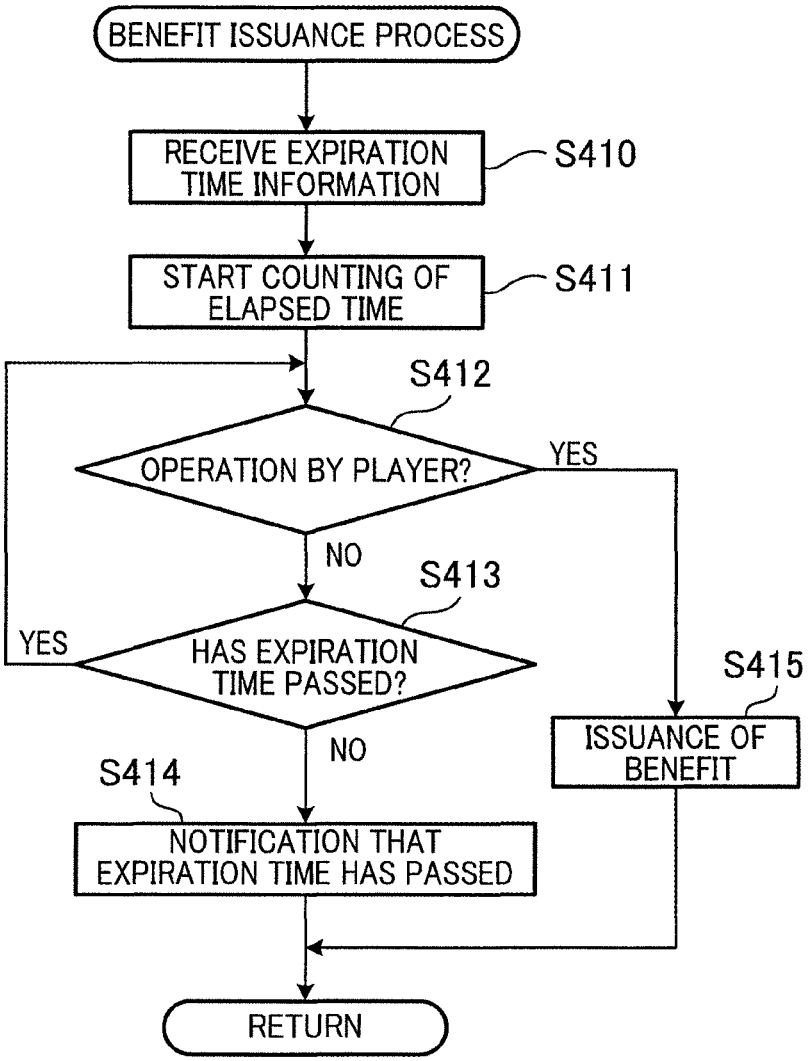
FIG. 21 is a flowchart of a benefit issuance process.

With reference to FIG. 20 and FIG. 21, the following will describe a service example 3 which is identical with the service example 2 shown in FIGS. 18 and 19 except that an expiration time is set for the issuance of a benefit. To be more specific, the service example 3 is a service when the benefit issuance device A5 includes a time measurement unit A54 which measures the time elapsed from output of instruction information from the hall management server 10 to the slot machine 1010, i.e., output of benefit information from the slot machine 1010 to an input to the input unit A51 by the player and a benefit issuance control unit A53 which causes the benefit issuance unit to issue a benefit when the expiration time has not arrived.

As shown in FIG. 20, when the hall management server 10 identifies addiction or quasi-addiction in the addiction/quasi-addiction determination process (SQ17), instruction information is sent to the slot machine 1010 and expiration time information is sent to the service terminal 200. The hall management server 10 may have sets of expiration time data assigned to service terminals 200 and signages 100, respectively, and may send such expiration time data to each service terminal 200 and each signage 100.

The service terminal 200 executes a benefit issuance process (SQ41). To be more specific, as shown in FIG. 21, when receiving expiration time information (S410), the service terminal 200 starts to measure the time elapsed (S411). Then whether an input is made by the player is determined (S412). When there is no input from the player (NO in S412), then whether the expiration time has arrived is determined (S413). When the expiration time has not arrived (YES in S413), an input from the player is waited for as the process is executed from S413 again. When an input is made by the player before the expiration time (YES in S412), a benefit is issued (S415).

Meanwhile, when the expiration date has arrived (NO in S413), image display indicating that the expiration time has arrived is performed for a predetermined time to notify the player that the expiration time has arrived. This notification regarding the expiration time may be performed when the player performs an input.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information provision system comprising:

a gaming machine capable of running a game;

a benefit issuance device which is provided at a location different from the gaming machine where a player plays the game;

an information manager including:

a first communication device, a storage device configured to store history information of the player, and a first processor configured to receive game information of the player from the gaming machine via the first communication device, and update the history information by storing the game information in association with the history information when the game information corresponds to identification information associated with the history information; and an information provision device including:

a second communication device, a second processor configured to receive the history information of the player from the information manager via the second communication device, determine whether to take an action for the player based on the history information of the player, and transmit instruction information to the gaming machine via the second communication device when determining that the action is taken for the player, and an input device which receives a use amount input by the player, wherein the use amount is budget of the player for playing games, wherein the gaming machine includes a benefit information output unit which is configured to output, based on the instruction information, benefit information, wherein the second processor is further configured to:

determine to change the use amount based on the history information of the player and sets the use amount based on a result of determining to change the use amount, and determine whether to take the action for the player based on whether an accumulated amount of the gaming value has reached the use amount, wherein the benefit issuance device includes:

an input unit to which the benefit information is input by the player;

a benefit issuance unit which is configured to issue a benefit associated with the benefit information;

a time measurement unit which is configured to measure time elapsed from output of the benefit information from the gaming machine to input to the input unit by the player; and a benefit issuance control unit which is configured to cause the benefit issuance unit to issue the benefit when an expiration time has not arrived based on the elapsed time, wherein when the history information of the player indicates a tendency of addiction to the game, the second processor determines to decrease the use amount at a decreasing rate, wherein the decreasing rate when the tendency of addiction to the game indicates a first tendency is higher than the decreasing rate when the tendency of addiction to the game indicates a second tendency lower than the first tendency, wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process, and wherein the gaming machine is configured to take a picture of a face of the player to generate image data of the face, and send the image data to the information provision device, and the first processor is further configured to specify the history information of the player by searching a database based on the image data received from the gaming machine.

2. The information provision system according to claim 1, wherein, the benefit issuance unit includes:

a benefit display unit which is configured to display plural types of benefits associated with the benefit information;

a selection unit which allows the player to select one of the plural types of benefits displayed by the benefit display unit; and an issuance processing unit which is configured to issue the benefit which is selected by using the selection unit.

3. The information provision system according to claim 1, wherein the second processor is further configured to determine whether to change the use amount based on the history information of the player according to all previous visits of the player.

4. An information provision device comprising:

a communication device;

a gaming value receiver which receives, as game information, a gaming value used by a player from a gaming machine via the communication device;

an input device which receives a use amount input by the player, wherein the use amount is budget of the player for playing games;

a storage device configured to store history information of the player;

a processor configured to update the history information by storing the game information in association with the history information when the game information corresponds to identification information associated with the history information;

determine to change the use amount based on the history information of the player and sets the use amount based on a result of determining to change the use amount; and determine whether to take an action for the player based on game information of the player; and transmit instruction information to a gaming machine via the communication device, in order to cause the gaming machine to output benefit information to the player, when determining that the action is taken for the player;

wherein the processor determines whether to take the action for the player based on whether an accumulated amount of the gaming value has reached the use amount, wherein a benefit associated with the benefit information is issued by a benefit issuance device, and wherein the benefit issuance device includes:

an input unit to which the benefit information is input by the player;

a benefit issuance unit which is configured to issue the benefit associated with the benefit information;

a time measurement unit which is configured to measure time elapsed from output of the benefit information from the gaming machine to input to the input unit by the player; and a benefit issuance control unit which is configured to cause the benefit issuance unit to issue the benefit when an expiration time has not arrived based on the elapsed time, wherein when the history information of the player indicates a tendency of addiction to the game, the processor determines to decrease the use amount at a decreasing rate, wherein the decreasing rate when the tendency of addiction to the game indicates a first tendency is higher than the decreasing rate when the tendency of addiction to the game indicates a second tendency lower than the first tendency, wherein information provision device communicates with the gaming machine, wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process, and wherein the gaming machine is configured to take a picture of a face of the player to generate image data of the face, and send the image data to the information provision device, and the processor is further configured to specify the history information of the player by searching a database based on the image data received from the gaming machine.

5. The information provision device according to claim 4, wherein the processor is further configured to determine whether to change the use amount based on the history information of the player according to all previous visits of the player.

6. An information provision method of causing a player at a gaming machine to stop playing a game, the method, performed by one or more processors, comprising:

receiving, as game information, a gaming value used by the player from the gaming machine;

updating history information by storing the game information in association with the history information when the game information corresponds to identification information associated with the history information stored;

receiving a use amount input by the player, wherein the use amount is budget of the player for playing games;

determining to change the use amount based on the history information of the player and setting the use amount based on a result of determining to change the use amount;

determining whether to take an action for the player based on game information of the player playing the game at the gaming machine, wherein the determining whether to take the action includes determining whether to take the action for the player based on whether an accumulated amount of the gaming value has reached the use amount; and when it is determined that the action is taken for the player, causing the gaming machine to output benefit information to the player, wherein the method further comprises:

receiving, by a benefit issuance device, the benefit information input by the player;

measuring, by the benefit issuance device, time elapsed from output of the benefit information from the gaming machine to input of the benefit information by the player; and issuing, by the benefit issuance device, a benefit associated with the benefit information when an expiration time has not arrived based on the elapsed time, wherein when the history information of the player indicates a tendency of addiction to the game, the use amount setting unit which determines to decrease the use amount at a decreasing rate, wherein the decreasing rate when the tendency of addiction to the game indicates a first tendency is higher than the decreasing rate when the tendency of addiction to the game indicates a second tendency lower than the first tendency, wherein the method further comprises further comprising communicating with the gaming machine, wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process, and wherein the method further comprises:

taking, by the gaming machine, a picture of a face of the player to generate image data of the face;

sending, by the gaming machine, the image data to the information provision device; and specifying the history information of the player by searching a database based on the image data received from the gaming machine.

7. The information provision method according to claim 6, wherein determining to change the use amount includes determining whether to change the use amount based on the history information of the player according to all previous visits of the player.

8. An information provision system comprising: a gaming machine capable of running a game by players; and an information provision device capable of communicating with the gaming machine, wherein the gaming machine includes:

an accepting device which accepts a gaming medium to update a credit amount; and a controller unit which executes the game based on the credit amount, executes a payout process based on a result of the game, and updates the credit amount based on the payout process, wherein the information provision device includes:

a communication device;

a storage device configured to store history information of each of the players; and a processor configured to receive game information of a player from the gaming machine via the communication device;

update the history information of the player by storing the game information in association with the history information when the game information corresponds to identification information associated with the history information;

determine whether to take an action for the player based on a use amount unique to the player, which is obtained based on the history information of the player, wherein the use amount is budget of the player for playing games; and transmit instruction information to the gaming machine via the communication device when determining that the action is taken for the player, and wherein the gaming machine further includes a benefit information output unit which outputs, based on the instruction information and the game information of the player, to the player benefit information, a benefit associated with the benefit information being issued at a location different from the gaming machine, and wherein content of the benefit information output by the benefit information output unit is changeable in accordance with a degree of addiction of the player, wherein the gaming machine is configured to take a picture of a face of the player to generate image data of the face, and send the image data to the information provision device, and the processor is further configured to specify the history information of the player by searching a database based on the image data received from the gaming machine.

9. The information provision system according to claim 8, wherein the processor is further configured to determine whether to change the use amount based on the history information of the player according to all previous visits of the player.

10. An information provision system comprising:

a gaming machine capable of running a game;

a benefit issuance device which is provided at a location different from the gaming machine where a player plays the game;

an information manager including:

a first communication device, a storage device configured to store history information of the player in a database, and a first processor configured to receive game information of the player from the gaming machine via the first communication device, and update the history information by storing the game information in association with the history information when the game information corresponds to identification information associated with the history information; and an information provision device including:

a second communication device, a second processor configured to receive the history information of the player from the information manager via the second communication device, determine whether to take an action for the player based on the history information of the player, and transmit instruction information to the gaming machine via the second communication device when determining that the action is taken for the player, and an input device which receives a use amount input by the player, wherein the use amount is budget of the player for playing games, wherein the gaming machine includes a benefit information output unit which is configured to output, based on the instruction information, benefit information, wherein the gaming machine is configured to take a picture of a face of the player to generate image data of the face, and send the image data to the information provision device, wherein the first processor is further configured to:

determine whether the player is a member by searching a database based on the image data received from the gaming machine;

specify the history information of the player by searching the database for the history information based on the identification information of the player in response to the player being the member; and determine a tendency of addiction to the game based on the specified history information, wherein the second processor is further configured to:

determine to change the use amount based on the history information of the player and sets the use amount based on a result of determining to change the use amount; and determine whether to take the action for the player based on whether an accumulated amount of the gaming value has reached the use amount, wherein the benefit issuance device includes:

an input unit to which the benefit information is input by the player;

a benefit issuance unit configured to issue a benefit associated with the benefit information;

a time measurement unit configured to measure time elapsed from output of the benefit information from the gaming machine to input to the input unit by the player; and a benefit issuance control unit configured to cause the benefit issuance unit to issue the benefit when an expiration time has not arrived based on the elapsed time, wherein when the history information of the player indicates the tendency of addiction to the game, the second processor determines to decrease the use amount at a decreasing rate, wherein the decreasing rate when the tendency of addiction to the game indicates a first tendency is higher than the decreasing rate when the tendency of addiction to the game indicates a second tendency lower than the first tendency, and wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process.

11. The information provision system according to claim 10, wherein the second processor is further configured to determine whether to change the use amount based on the history information of the player according to all previous visits of the player.

12. An information provision device comprising:

a communication device;

a gaming value receiver which receives, as game information, a gaming value used by a player from a gaming machine via the communication device;

an input device which receives a use amount input by the player, wherein the use amount is budget of the player for playing games;

a storage device configured to store history information of the player in a database; and a processor configured to:

update the history information by storing the game information in association with the history information when the game information corresponds to identification information associated with the history information, determine to change the use amount based on the history information of the player and sets the use amount based on a result of determining to change the use amount, determine whether to take an action for the player based on game information of the player, and transmit instruction information to a gaming machine via the communication device, in order to cause the gaming machine to output benefit information to the player, when determining that the action is taken for the player, wherein the processor is further configured to determine whether to take the action for the player based on whether an accumulated amount of the gaming value has reached the use amount, wherein a benefit associated with the benefit information is issued by a benefit issuance device which is provided at a location different from the gaming machine, and wherein the benefit issuance device includes:

an input unit to which the benefit information is input by the player;

a benefit issuance unit which is configured to issue the benefit associated with the benefit information;

a time measurement unit which is configured to measure time elapsed from output of the benefit information from the gaming machine to input to the input unit by the player; and a benefit issuance control unit which is configured to cause the benefit issuance unit to issue the benefit when an expiration time has not arrived based on the elapsed time, wherein the gaming machine is configured to take a picture of a face of the player to generate image data of the face, and send the image data to the information provision device, wherein the processor is further configured to:

determine whether the player is a member by searching a database based on the image data received from the gaming machine;

specify the history information of the player by searching the database for the history information based on the identification information of the player in response to the player being the member; and determine a tendency of addiction to the game based on the specified history information, wherein when the specified history information of the player indicates the tendency of addiction to the game, the processor determines to decrease the use amount at a decreasing rate, wherein the decreasing rate when the tendency of addiction to the game indicates a first tendency is higher than the decreasing rate when the tendency of addiction to the game indicates a second tendency lower than the first tendency, wherein information provision device communicates with the gaming machine, and wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process.

13. The information provision device according to claim 12, wherein the processor is further configured to determine whether to change the use amount based on the history information of the player according to all previous visits of the player.

14. An information provision method of causing a player at a gaming machine to stop playing a game, the method, performed by one or more processors, comprising:

receiving, as game information, a gaming value used by the player from the gaming machine;

updating history information in a database by storing the game information in association with the history information when the game information corresponds to identification information associated with the history information stored;

receiving a use amount input by the player, wherein the use amount is budget of the player for playing games;

determining to change the use amount based on the history information of the player and setting the use amount based on a result of determining to change the use amount;

determining whether to take an action for the player based on game information of the player playing the game at the gaming machine, wherein the determining whether to take the action includes determining whether to take the action for the player based on whether an accumulated amount of the gaming value has reached the use amount; and when it is determined that the action is taken for the player, causing the gaming machine to output benefit information to the player, wherein the method further comprises:

receiving, by a benefit issuance device which is provided at a location different from the gaming machine, the benefit information input by the player;

measuring, by the benefit issuance device, time elapsed from output of the benefit information from the gaming machine to input of the benefit information by the player; and issuing, by the benefit issuance device, a benefit associated with the benefit information when an expiration time has not arrived based on the elapsed time, wherein the gaming machine is configured to take a picture of a face of the player to generate image data of the face, and send the image data to the information provision device, wherein the method further comprises:

determining whether the player is a member by searching a database based on the image data received from the gaming machine, specifying the history information of the player by searching the database for the history information based on the identification information of the player in response to the player being the member; and determining a tendency of addiction to the game based on the specified history information, wherein when the specified history information of the player indicates the tendency of addiction to the game, the use amount setting unit which determines to decrease the use amount at a decreasing rate, wherein the decreasing rate when the tendency of addiction to the game indicates a first tendency is higher than the decreasing rate when the tendency of addiction to the game indicates a second tendency lower than the first tendency, wherein the method further comprises further comprising communicating with the gaming machine, and wherein the gaming machine further includes:

an accepting device which accepts a gaming medium representing the gaming value to update a credit amount; and a controller unit which executes the game based on the credit amount, executes a payout process based on a result of the game, and updates the credit amount based on the payout process.

15. The information provision method according to claim 14, wherein determining to change the use amount includes determining whether to change the use amount based on the history information of the player according to all previous visits of the player.

16. An information provision system comprising:

a gaming machine capable of running a game by players; and an information provision device capable of communicating with the gaming machine, wherein the gaming machine includes:

an accepting device which accepts a gaming medium to update a credit amount; and a controller unit which executes the game based on the credit amount, executes a payout process based on a result of the game, and updates the credit amount based on the payout process, wherein the information provision device includes:

a communication device;

a storage device configured to store history information of each of the players in a database; and a processor configured to receive game information of a player from the gaming machine via the communication device, update the history information of the player by storing the game information in association with the history information when the game information corresponds to identification information associated with the history information, determine whether to take an action for the player based on a use amount unique to the player, which is obtained based on the history information of the player, wherein the use amount is budget of the player for playing games, and transmit instruction information to the gaming machine via the communication device when determining that the action is taken for the player, and wherein the gaming machine is configured to take a picture of a face of the player to generate image data of the face, and send the image data to the information provision device, wherein the processor is further configured to:

determine whether the player is a member by searching a database based on the image data received from the gaming machine, specify the history information of the player by searching the database for the history information based on the identification information in response to the player being the member, and determine a degree of addiction to the game based on the specified history information, wherein the gaming machine further includes a benefit information output unit which outputs, based on the instruction information and the game information of the player, to the player benefit information, a benefit associated with the benefit information being issued at a location different from the gaming machine, and wherein content of the benefit information output by the benefit information output unit is changeable in accordance with the degree of addiction of the player.

17. The information provision system according to claim 16, wherein the processor is further configured to determine whether to change the use amount based on the history information of the player according to all previous visits of the player.

* * * * *